US010155381B2

(12) United States Patent
Matsumoto et al.

(10) Patent No.: US 10,155,381 B2
(45) Date of Patent: Dec. 18, 2018

(54) LIQUID DISCHARGE HEAD AND RECORDING DEVICE

(71) Applicant: KYOCERA Corporation, Kyoto-shi, Kyoto (JP)

(72) Inventors: Yuka Matsumoto, Kirishima (JP); Naoki Kobayashi, Kirishima (JP); Hiroyuki Kawamura, Kirishima (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 15/128,263

(22) PCT Filed: Mar. 27, 2015

(86) PCT No.: PCT/JP2015/059808

§ 371 (c)(1),
(2) Date: Sep. 22, 2016

(87) PCT Pub. No.: WO2015/147307

PCT Pub. Date: Oct. 1, 2015

(65) Prior Publication Data

US 2017/0239948 A1 Aug. 24, 2017

(30) Foreign Application Priority Data

Mar. 27, 2014 (JP) ..... 2014-065771

(51) Int. Cl.
*B41J 2/14* (2006.01)
*B41J 2/18* (2006.01)
(Continued)

(52) U.S. Cl.
CPC ..... *B41J 2/14233* (2013.01); *B41J 2/14209* (2013.01); *B41J 2/155* (2013.01);
(Continued)

(58) Field of Classification Search
CPC ... B41J 2/14233; B41J 2/18; B41J 2/21; B41J 2002/14306; B41J 2202/12; B41J 2002/14419
See application file for complete search history.

(56) References Cited

U.S. PATENT DOCUMENTS 6,331,050 B1 12/2001 Nakata et al.
2006/0132552 A1 6/2006 Ito
(Continued)

FOREIGN PATENT DOCUMENTS

JP 3158671 B2 4/2001
JP 2006-175741 A 7/2006
(Continued)

OTHER PUBLICATIONS

Extended European Search Report, European Patent Application No. 15769121.3, dated Oct. 18, 2017, 10 pgs.
(Continued)

*Primary Examiner* — Geoffrey S Mruk
(74) *Attorney, Agent, or Firm* — Volpe and Koenig, P.C.

(57) ABSTRACT

A liquid discharge head includes a flow passage member and a plurality of pressurizing sections. The flow passage member includes a plurality of discharge holes, a plurality of pressurizing chambers connected to a plurality of the discharge holes, a plurality of first flow passages connected to a plurality of the pressurizing chambers, a second flow passage connected in common to a plurality of the first flow passages, a plurality of third flow passages connected to a plurality of the pressurizing chambers, and a fourth flow passage connected in common to a plurality of the third flow passages. The pressurizing sections pressurize liquid in the pressurizing chambers. The third flow passage has a wide section connected to the pressurizing chamber and a narrow section connecting the wide section and the fourth flow passage. The wide section is disposed toward the discharge hole of the pressurizing chamber.

16 Claims, 12 Drawing Sheets

(51) Int. Cl.
*B41J 2/155* (2006.01)
*B41J 2/21* (2006.01)

(52) U.S. Cl.
CPC . *B41J 2/18* (2013.01); *B41J 2/21* (2013.01); *B41J 2002/14306* (2013.01); *B41J 2002/14419* (2013.01); *B41J 2002/14459* (2013.01); *B41J 2202/11* (2013.01); *B41J 2202/12* (2013.01); *B41J 2202/20* (2013.01)

(56) References Cited

U.S. PATENT DOCUMENTS

| | | | | |
|---|---|---|---|---|
| 2011/0148988 | A1* | 6/2011 | Hoisington | B41J 2/14233 347/54 |
| 2011/0187773 | A1 | 8/2011 | Kusakari et al. | |
| 2011/0242226 | A1 | 10/2011 | Yoshida et al. | |
| 2011/0279552 | A1 | 11/2011 | Yoshida et al. | |
| 2012/0160925 | A1* | 6/2012 | Hoisington | B41J 2/14233 239/1 |

FOREIGN PATENT DOCUMENTS

| | | | |
|---|---|---|---|
| JP | 2007-106016 | A | 4/2007 |
| JP | 2007-125798 | A | 5/2007 |
| JP | 2007-125808 | A | 5/2007 |
| JP | 2009-143168 | A | 7/2009 |
| JP | 2011-240343 | A | 12/2011 |
| JP | 2012-006350 | A | 1/2012 |
| JP | 2012-011629 | A | 1/2012 |

OTHER PUBLICATIONS

International Search Report, PCT/JP2015/059808, dated Jun. 16, 2015, 2 pgs.

* cited by examiner

LIQUID DISCHARGE HEAD AND RECORDING DEVICE

TECHNICAL FIELD

The present invention relates to a liquid discharge head and a recording device.

BACKGROUND ART

Conventionally, there have been proposed, as a printing head, a liquid discharge head for performing various printing tasks by discharging liquid onto a recording medium. As such a liquid discharge head, a known liquid discharge head includes a flow passage member and a plurality of pressurizing sections. The flow passage member includes a plurality of discharge holes, a plurality of pressurizing chambers respectively connected to a plurality of the discharge holes, a plurality of first flow passages respectively connected to a plurality of the pressurizing chambers, a second flow passage connected in common to a plurality of the first flow passages, a plurality of third flow passages respectively connected to a plurality of the pressurizing chambers, and a fourth flow passage connected in common to a plurality of the third flow passages. A plurality of the pressurizing sections respectively pressurizes liquid in a plurality of the pressurizing chambers.

It is known that the above described liquid discharge head circulates liquid even when the liquid is not discharged so that a pigment contained in the liquid does not stagnate in various flow passages in a flow passage member to prevent a discharge hole from being clogged (for example, see Patent Document 1).

RELATED ART DOCUMENT

Patent Document

Patent Document 1: Japanese Unexamined Patent Application Publication No. 2009-143168

SUMMARY OF THE INVENTION

Problems to be Solved by the Invention

However, the above described liquid discharge head likely creates a region in which the liquid can stagnate inside the pressurizing chamber to cause the discharge hole to clog.

Means for Solving the Problems

A liquid discharge head according to an embodiment of the present invention includes a flow passage member and a plurality of pressurizing sections. The flow passage member includes a plurality of discharge holes, a plurality of pressurizing chambers respectively connected to a plurality of the discharge holes, a plurality of first flow passages respectively connected to a plurality of the pressurizing chambers, a second flow passage connected in common to a plurality of the first flow passages, a plurality of third flow passages respectively connected to a plurality of the pressurizing chambers, and a fourth flow passage connected in common to a plurality of the third flow passages. A plurality of the pressurizing sections respectively pressurizes liquid in a plurality of the pressurizing chambers. In addition, the third flow passage has a wide section connected to the pressurizing chamber, and a narrow section connecting the wide section and the fourth flow passage. In addition, the wide section is disposed toward the discharge hole of the pressurizing chamber.

A recording device according to an embodiment of the present invention includes the liquid discharge head, a conveyor for conveying a recording medium toward the liquid discharge head, and a control section for controlling the liquid discharge head.

Effects of the Invention

According to the first aspect of the present invention, it is possible to reduce a possibility of creating a region in which liquid stagnates inside a pressurizing chamber to prevent as much as possible a discharge hole from being clogged.

EMBODIMENTS FOR CARRYING OUT THE INVENTION

<First Embodiment>

Figure 1A:
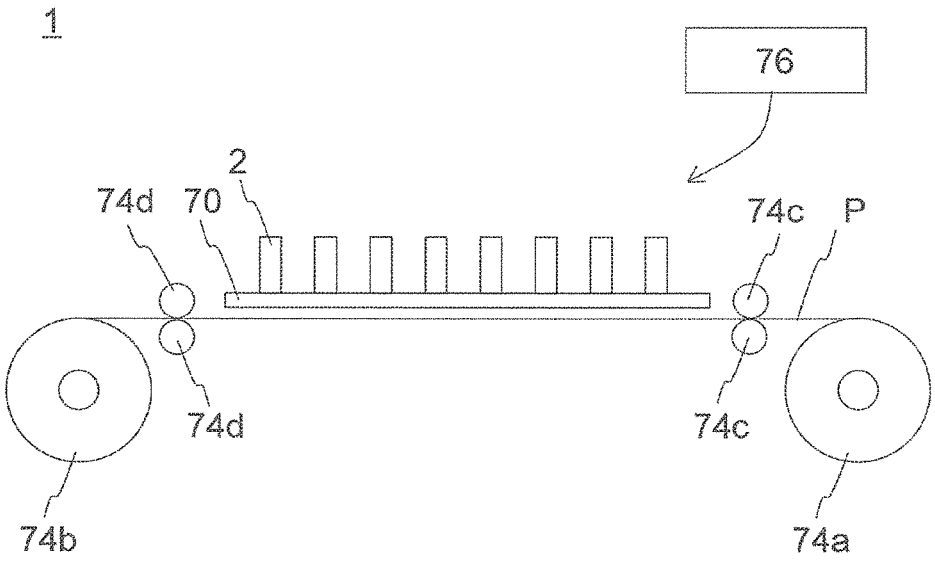
FIG. 1(*a*) is a side view schematically illustrating a recording device including a liquid discharge head, according to a first embodiment of the present invention, and FIG. 1(*b*) is a plan view schematically illustrating the recording device including the liquid discharge head, according to the first embodiment of the present invention.
Figure 1B:
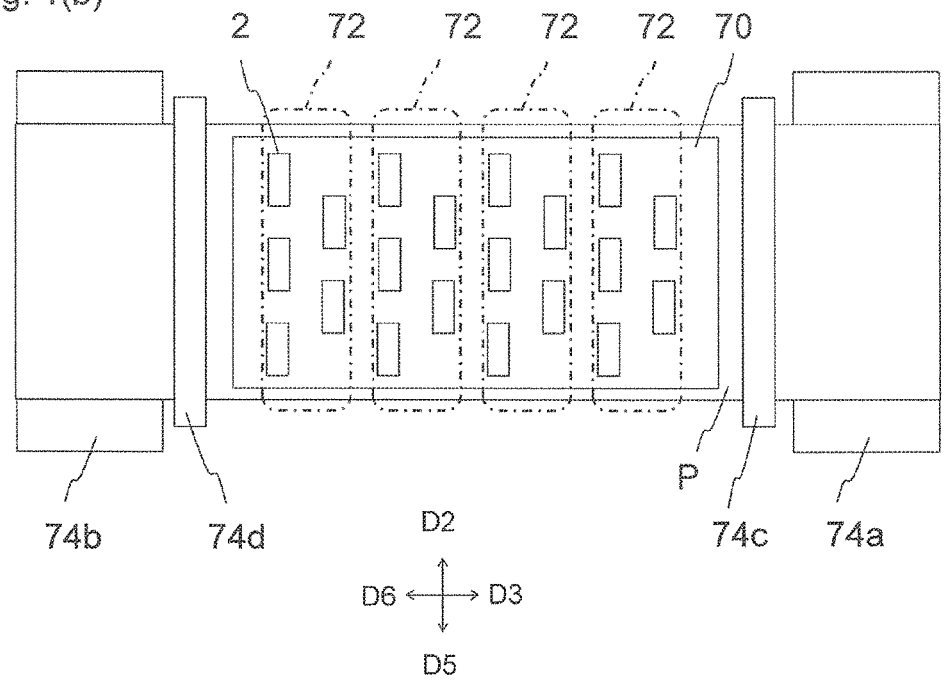

With reference to FIG. 1, a color inkjet printer 1 (hereinafter referred to as printer 1) including a liquid discharge head 2 according to a first embodiment of the present invention will now be described herein.

The printer 1 conveys a recording medium P from a conveying roller 74*a* to a conveying roller 74*b* to move the recording medium P relative to the liquid discharge head 2. A control section 76 controls the liquid discharge head 2 based on data such as an image and a text so as to discharge liquid toward the recording medium P to project droplets onto the recording medium P to perform printing on the recording medium P.

In the first embodiment, the liquid discharge head 2 is fixed to the printer 1 so that the printer 1 operates as a line printer. Another embodiment of the recording device may be a serial printer.

On the printer 1, a tabular head mounting frame 70 is fixed approximately parallel to the recording medium P. On the head mounting frame 70, 20 holes (not shown) are provided, and the 20 liquid discharge heads 2 are respectively mounted over the holes. The five liquid discharge heads 2 configure a head group 72, and the printer 1 has the four head groups 72.

The liquid discharge head 2 has a thin, long shape, as shown in FIG. 1(*b*). In the one head group 72, the three liquid discharge heads 2 are arranged along a direction intersecting a conveying direction of the recording medium P, while the other two liquid discharge heads 2 are each arranged between the three liquid discharge heads 2, but offset along the conveying direction. The adjoining liquid discharge heads 2 are disposed to join regions printable with the liquid discharge heads 2 in a width direction of the recording medium P, or to allow edges of the printable regions to overlap so that printing is possible in a seamless manner in the width direction of the recording medium P.

The four head groups 72 are disposed along the conveying direction of the recording medium P. The liquid discharge heads 2 are each supplied with ink from a liquid tank (not shown). The liquid discharge heads 2 belonging to the one head groups 72 are supplied with ink of an identical color, thus the four head groups perform a print with inks of four colors. Colors of inks each discharged from the head groups 72 include, for example, magenta (M), yellow (Y), cyan (C), and black (K).

Moreover, a number of the liquid discharge heads 2 mounted on the printer 1 may be only one provided that the single liquid discharge head 2 prints a printable region with a single color. A number of the liquid discharge heads 2 included in each of the head groups 72 or a number of the head groups 72 may be appropriately changed depending on a print target or a print condition. For example, in order to perform further multi-color printing, a number of the head groups 72 may be increased. In addition, by disposing a plurality of the head groups 72 for printing with an identical color to alternately perform printing in the conveying direction, a print speed, i.e. conveying speed, can be increased. In addition, by preparing and disposing a plurality of the head groups 72 for printing in an identical color in a direction intersecting with the conveying direction, a resolution in a width direction of the recording medium P may be increased.

Further, in addition to performing printing with a colored ink, liquid such as a coating agent may be printed to perform a surface treatment for the recording medium P.

The printer 1 performs printing onto the recording medium P. The recording medium P wound onto the conveying roller 74*a* passes between two conveying rollers 74*c*, and then passes under the liquid discharge heads 2 mounted on the head mounting frame 70. After that, the recording medium P passes between other two conveying rollers 74*d*, and is finally collected by the conveying roller 74*b*.

The recording medium P may be cloth, in addition to printing paper. In addition, instead of the recording medium P, the printer 1 may convey a conveying belt, and, in addition to a roll-shaped recording medium, a sheet paper, a cut piece of cloth, a wooden material, or a tile may be placed on the conveying belt. Further, the liquid discharge heads 2 may discharge liquid containing conductive particles to print a wiring pattern for an electronic device. Still further, the liquid discharge heads 2 may discharge, toward a reactor vessel, a predetermined amount of a liquid chemical agent or liquid containing a chemical agent for reaction to produce a chemical product.

In addition, the printer 1 may be attached with a position sensor, a speed sensor, and a temperature sensor, so that the control section 76 controls components of the printer 1 in accordance with conditions of the components of the printer 1 known based on information sent from the sensors. In particular, if a discharging characteristic (discharge amount, discharge speed, and others) of liquid discharged by the liquid discharge heads 2 is affected by an external factor, a drive signal that causes the liquid discharge heads 2 to discharge the liquid may be changed in accordance with a temperature in the liquid discharge heads 2, a liquid temperature in the liquid tank, and a liquid pressure applied from the liquid tank to the liquid discharge heads 2.

Next, with reference to FIGS. 2 to 10, the liquid discharge head 2 according to the first embodiment will now be described herein. Moreover, in FIGS. 5 to 10, for easy understanding of the drawings, flow passages and other components that position under other members, thus should be rendered with a broken line, are rendered with a solid line. In addition, in FIG. 5(*a*), a second flow passage member 6 is partially shown in transparent, and, in FIG. 5(*b*), the second flow passage member 6 is entirely shown in transparent. In addition, in FIG. 8, only a second individual flow passage is shown with a solid line, which is also applicable to FIGS. 10 and 11. In FIG. 9, the second individual flow passage is shown with a broken line.

Moreover, drawings are shown with a first direction D1, a second direction D2, a third direction D3, a fourth direction D4, a fifth direction D5, and a sixth direction D6. The first direction D1 is a direction toward which a first common flow passage 20 and a second common flow passage 24 extend, and the fourth direction D4 is another direction toward which the first common flow passage 20 and the second common flow passage 24 extend. The second direction D2 is a direction toward which a first integrated flow passage 22 and a second integrated flow passage 26 extend, and the fifth direction D5 is another direction toward which the first integrated flow passage 22 and the second integrated flow passage 26 extend. The third direction D3 is a direction orthogonal to the direction toward which the first integrated flow passage 22 and the second integrated flow passage 26 extend, and the sixth direction D6 is another direction orthogonal to the other direction toward which the first integrated flow passage 22 and the second integrated flow passage 26 extend.

The liquid discharge head 2 is described with a first individual flow passage 12, as the first flow passage, the first common flow passage 20, as the second flow passage, a second individual flow passage 14, as the third flow passage, and the second common flow passage 24, as the fourth flow passage.

Figure 2:
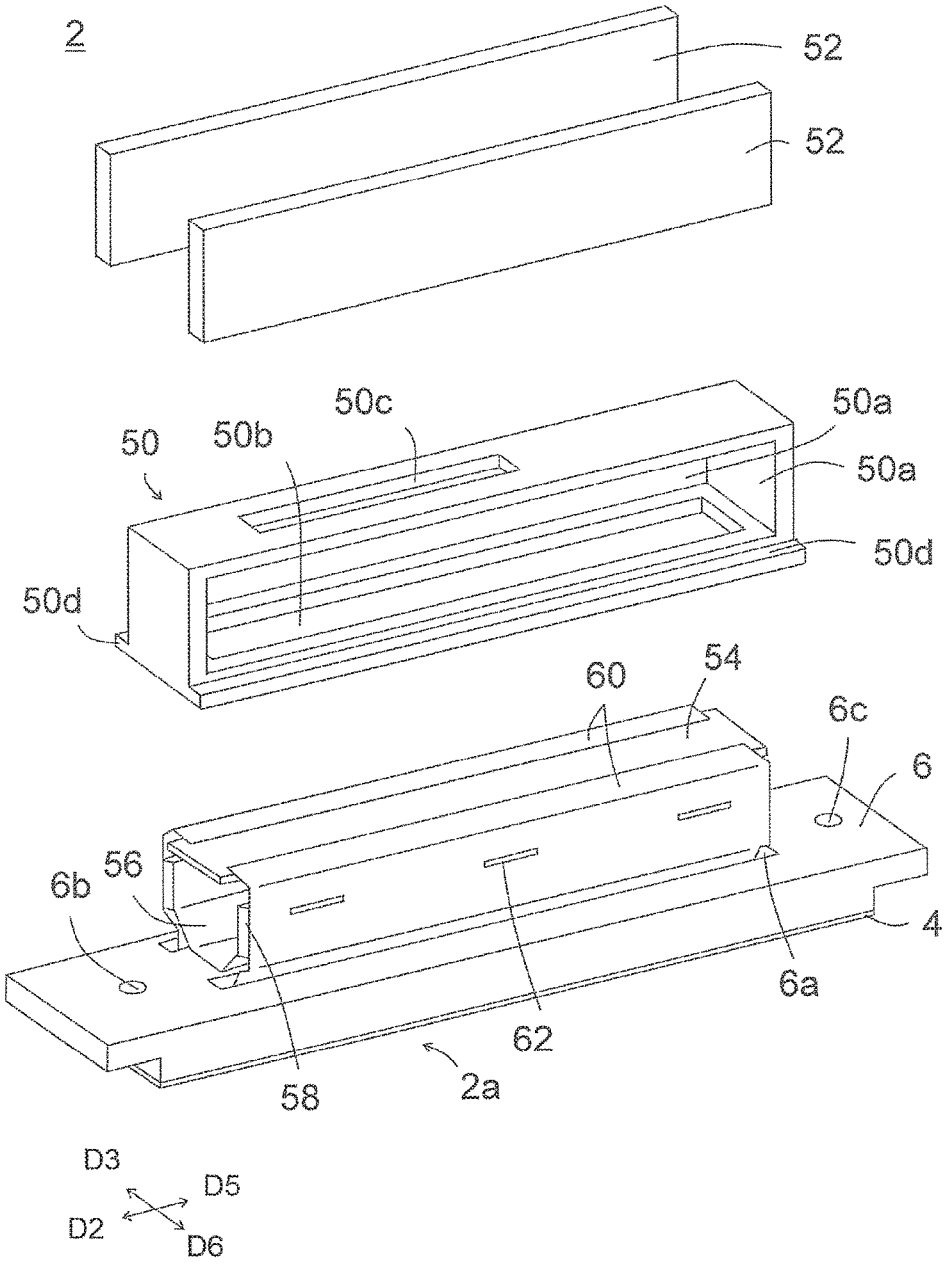
FIG. 2 is an exploded perspective view of the liquid discharge head according to the first embodiment of the present invention.
Figure 3A:
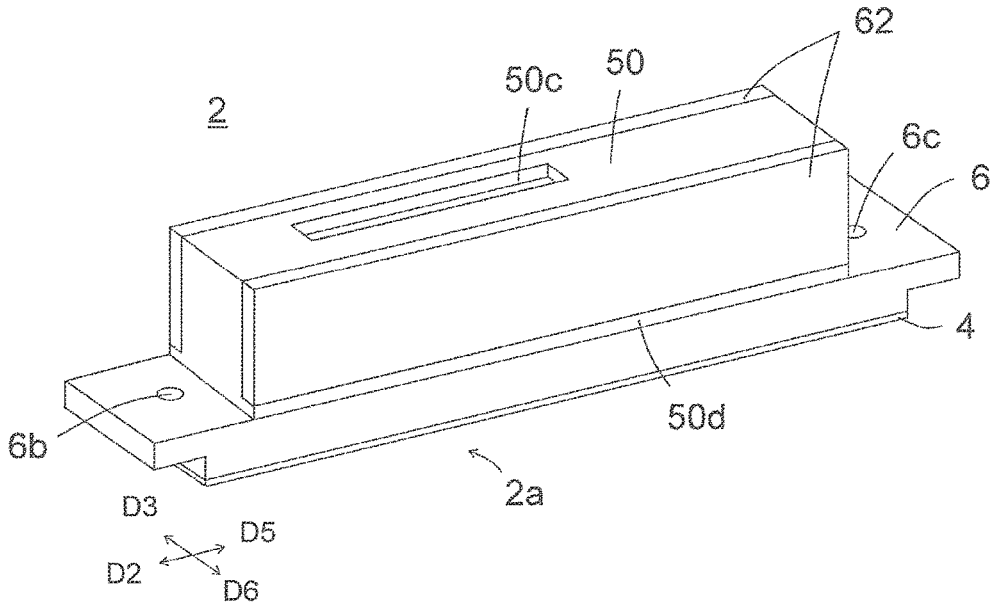
FIG. 3(*a*) is a perspective view of the liquid discharge head shown in FIG. 2, and FIG. 3(*b*) is a cross-sectional view of the liquid discharge head shown in FIG. 2.
Figure 3B:
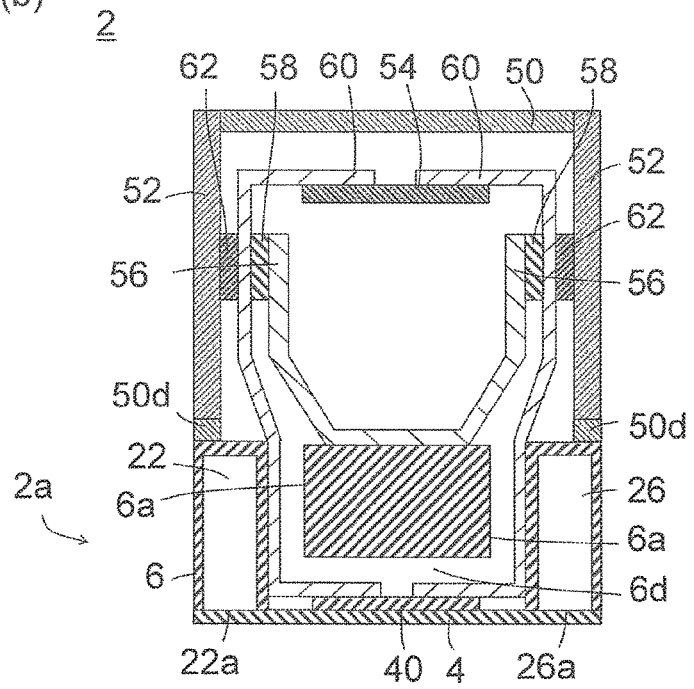

As shown in FIG. 2, the liquid discharge head 2 includes a head body 2*a*, a housing 50, heat sinks 52, a circuit board 54, a press member 56, elastic members 58, signal transmission sections 60, and driver ICs 62. Moreover, the liquid discharge head 2 may at least include the head body 2*a*, and may not necessarily include the housing 50, the heat sinks 52, the circuit board 54, the press member 56, the elastic members 58, the signal transmission sections 60, and the driver ICs 62.

On the liquid discharge head 2, the signal transmission sections 60 extend from the head body 2*a*, and the signal transmission sections 60 are electrically connected to the circuit board 54. The signal transmission sections 60 are provided with the driver ICs 62 for driving and controlling the liquid discharge head 2. The driver ICs 62 are pressed onto the heat sinks 52 by the press member 56 via the elastic members 58. Moreover, a supporting member supporting the circuit board 54 is omitted from the drawings.

The heat sinks 52 may be formed of a metal or an alloy, and are provided to externally radiate heat of the driver ICs 62. The heat sinks 52 are joined to the housing 50 by means of a screw or an adhesive.

The housing 50 is mounted on the head body 2*a* so that the housing 50 and the heat sinks 52 cover each member configuring the liquid discharge head 2. The housing 50 includes openings 50*a*, 50*b*, and 50*c*, and thermal insulation sections 50*d*. The openings 50*a* are provided to respectively face the third direction D3 and the sixth direction D6, and the first openings 50*a* are disposed with the heat sinks 52. The second opening 50*b* opens downwardly so that, via the second opening 50*b*, the circuit board 54 and the press member 56 are disposed inside the housing 50. The third opening 50*c* opens upwardly to house a connector (not shown) provided for the circuit board 54.

The thermal insulation sections 50*d* are provided to extend from the second direction D2 to the fifth direction D5, and are disposed between the heat sinks 52 and the head body 2*a*. Therefore, heat radiated to the heat sinks 52 is prevented as much as possible from being transmitted to the head body 2*a*. The housing 50 may be formed of a metal, an alloy, or a resin.

Figure 4A:
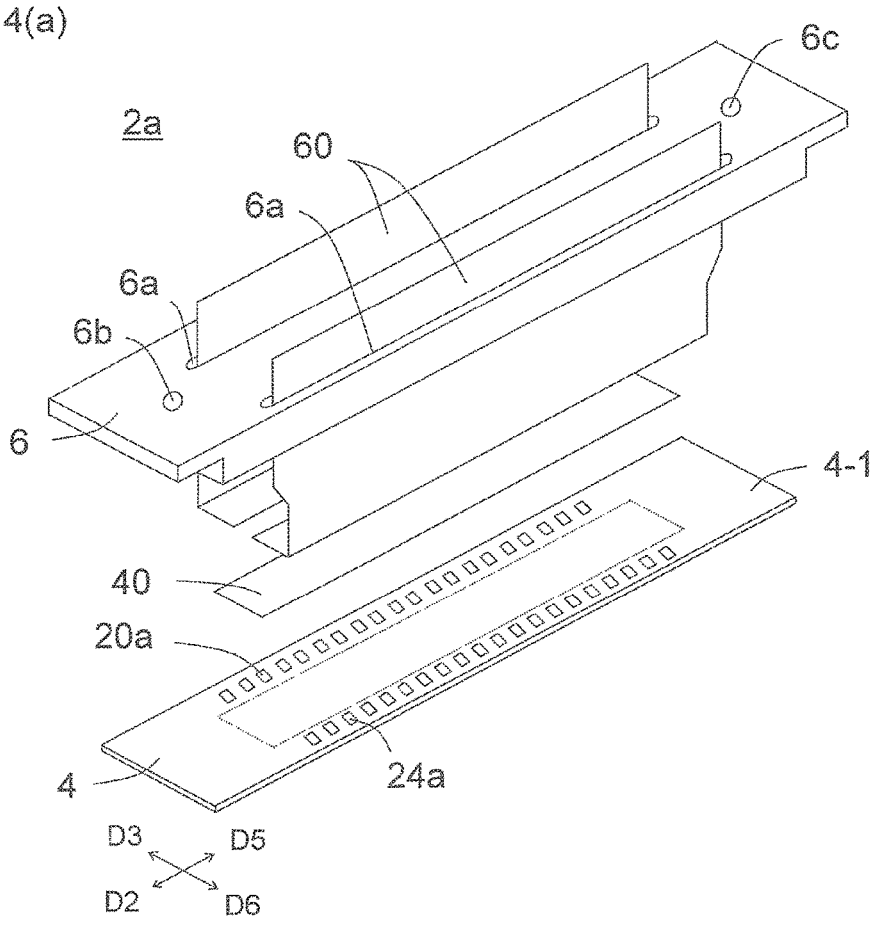
FIG. 4(*a*) is an exploded perspective view of a head body, and FIG. 4(*b*) is a perspective view of a second flow passage member when seen from an under surface of the second flow passage member.
Figure 4B:
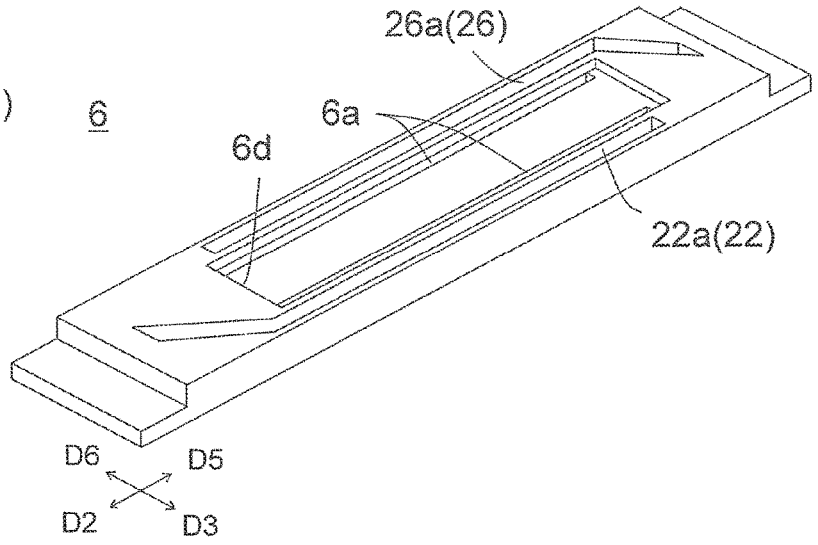

As shown in FIG. 4(*a*), the head body 2*a* has a tabular shape extending from the second direction D2 to the fifth direction D5, and has a first flow passage member 4, a second flow passage member 6, and a piezoelectric actuator substrate 40. On the head body 2*a*, the piezoelectric actuator substrate 40 and the second flow passage member 6 are disposed on the first flow passage member 4. The piezoelectric actuator substrate 40 is mounted in a region indicated with a broken line in FIG. 4(*a*). The piezoelectric actuator substrate 40 is provided to pressurize a plurality of pressurizing chambers 10 (see FIG. 7(*b*)) provided on the first flow passage member 4, and includes a plurality of displacement elements 48 (see FIG. 7(*b*)).

The first flow passage member 4 is internally formed with flow passages to guide liquid supplied from the second flow passage member 6 to a discharge hole 8. On the first flow passage member 4, a pressurizing chamber surface 4-1 is formed on a main surface, and, on the pressurizing chamber surface 4-1, openings 20*a* and 24*a* are formed. The openings 20*a* are arranged from the second direction D2 to the fifth direction D5, and are disposed on an edge, in the third direction D3, of the pressurizing chamber surface 4-1. The openings 24*a* are arranged from the second direction D2 to the fifth direction D5, and are disposed on another edge, in the sixth direction D6, of the pressurizing chamber surface 4-1.

The second flow passage member 6 is internally formed with flow passages to guide liquid supplied from the liquid tank to the first flow passage member 4. The second flow passage member 6 is provided on an outer periphery portion of a pressurizing chamber surface 4-1 of the first flow passage member 4, and is joined to the first flow passage member 4, via an adhesive (not shown), outside the mount region of the piezoelectric actuator substrate 40.

Figure 5A:
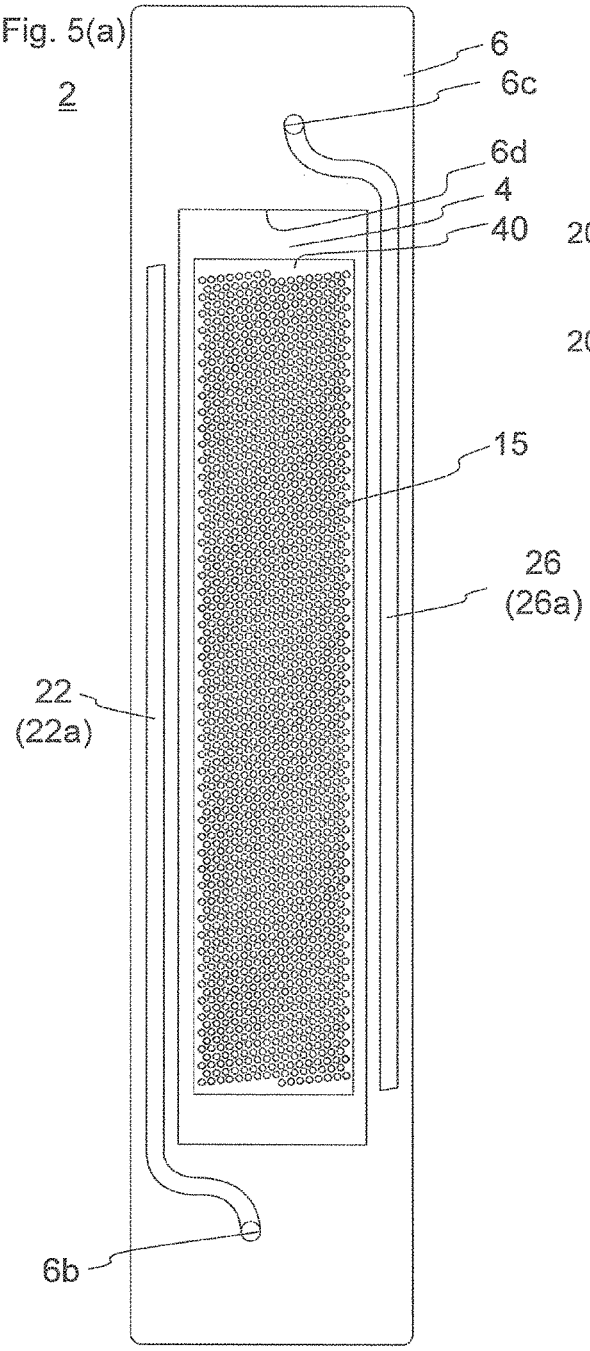
FIG. 5(*a*) is a plan view of the head body when the second flow passage member is partially made transparent, and FIG. 5(*b*) is another plan view of the head body when the second flow passage member is made transparent.
Figure 5B:
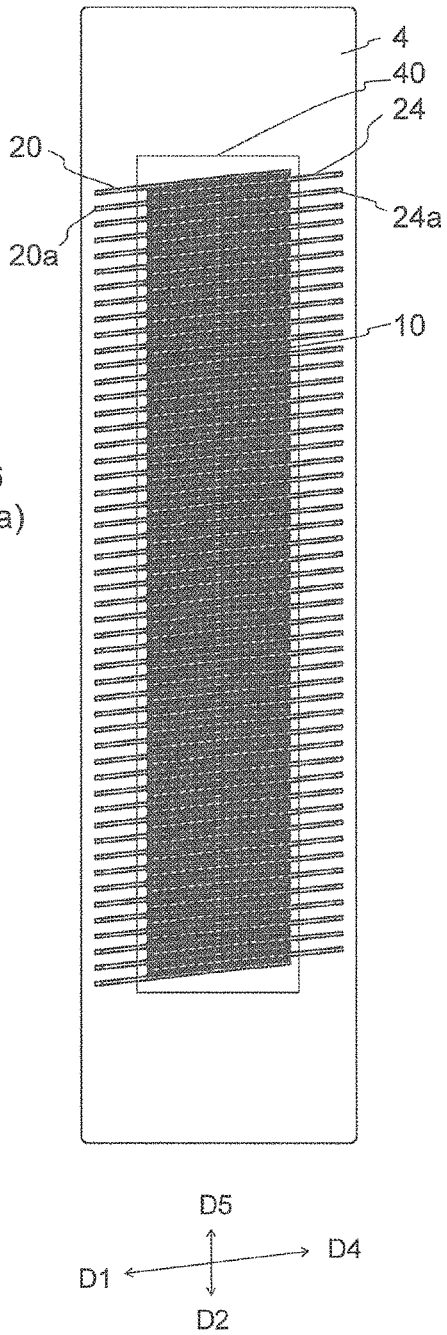

The second flow passage member 6 is, as shown in FIGS. 4 and 5, formed with through holes 6*a*, and openings 6*b*, 6*c*, 6*d*, 22*a*, and 26*a*. The through holes 6*a* are formed to extend from the second direction D2 to the fifth direction D5, and are disposed outside the mount region of the piezoelectric actuator substrate 40. The through holes 6*a* are inserted with the signal transmission sections 60.

The opening 6*b* is provided on an upper surface of the second flow passage member 6, and is disposed on an edge, in the second direction D2, of the second flow passage member 6. The opening 6*b* supplies liquid from the liquid tank to the second flow passage member 6. The opening 6*c* is provided on the upper surface of the second flow passage member 6, and is disposed on another edge, in the fifth direction D5, of the second flow passage member 6. The opening 6*c* collects the liquid from the second flow passage member 6 to the liquid tank. The opening 6*d* is provided on an under surface of the second flow passage member 6, and the piezoelectric actuator substrate 40 is disposed in a space formed by the opening 6*d*.

The opening 22*a* is provided on the under surface of the second flow passage member 6, and extends from the second direction D2 to the fifth direction D5. The opening 22*a* is formed on an edge, in the third direction D3, of the second flow passage member 6 so as to face toward the third direction D3 farther from the through hole 6*a*.

The opening 22*a* communicates with the opening 6*b*, and forms the first integrated flow passage 22 when the opening 22*a* is sealed by the first flow passage member 4. The first integrated flow passage 22 is formed to extend from the second direction D2 to the fifth direction D5 to supply liquid to the openings 20*a* of the first flow passage member 4.

The opening 26*a* is provided on the under surface of the second flow passage member 6, and extends from the second direction D2 to the fifth direction D5. The opening 26*a* is formed on another edge, in the sixth direction D6, of the second flow passage member 6 so as to face toward the sixth direction D6 farther from the through hole 6*a*.

The opening 26*a* communicates with the opening 6*b*, and forms the second integrated flow passage 26 when the opening 26*a* is sealed by the first flow passage member 4. The second integrated flow passage 26 is formed to extend from the second direction D2 to the fifth direction D5 to collect the liquid from the openings 24*a* of the first flow passage member 4.

With a configuration described above, in the second flow passage member 6, liquid supplied from the liquid tank to the opening 6*b* is supplied to the first integrated flow passage 22, and flows, via the opening 22*a*, into the first common flow passage 20 so that the liquid is supplied into the first flow passage member 4. And then the liquid collected through the second common flow passage 24 flows, via the opening 26*a*, into the second integrated flow passage 26 so that the liquid is collected externally via the opening 6*c*. Moreover, the second flow passage member 6 may not necessarily be provided.

Figure 6:
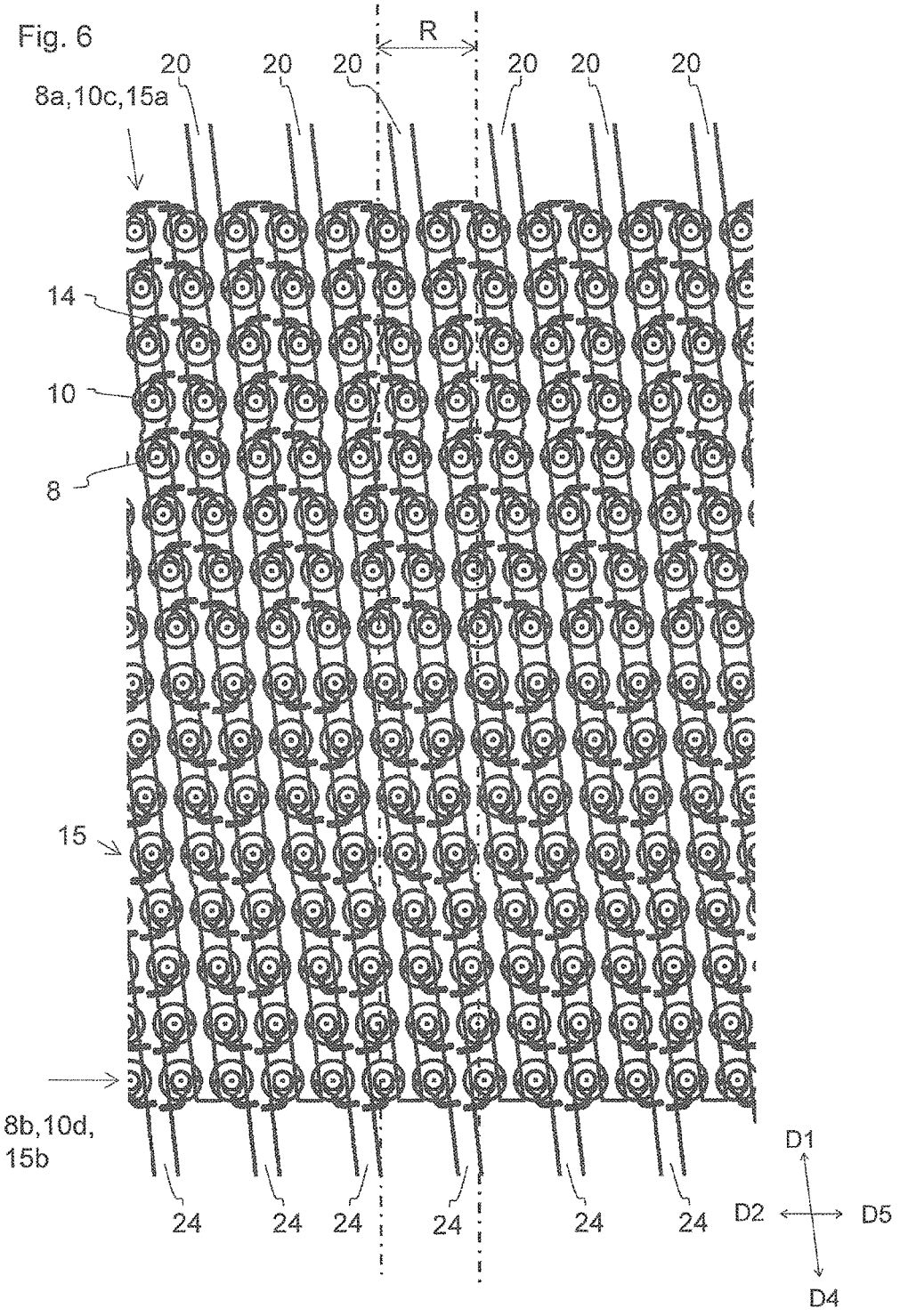
FIG. 6 is an enlarged plan view of part of FIG. 5.
Figure 7A:
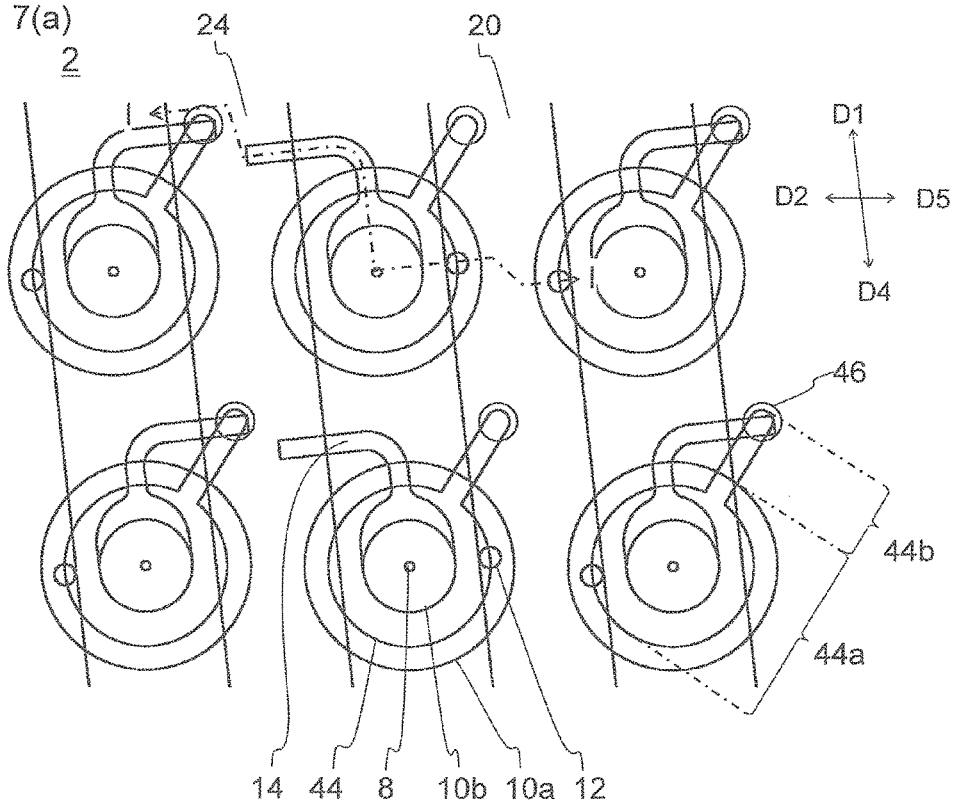
FIG. 7(*a*) is an enlarged plan view of part of FIG. 6, and FIG. 7(*b*) is a cross-sectional view taken along the line I-I in FIG. 6(*a*).
Figure 7B:
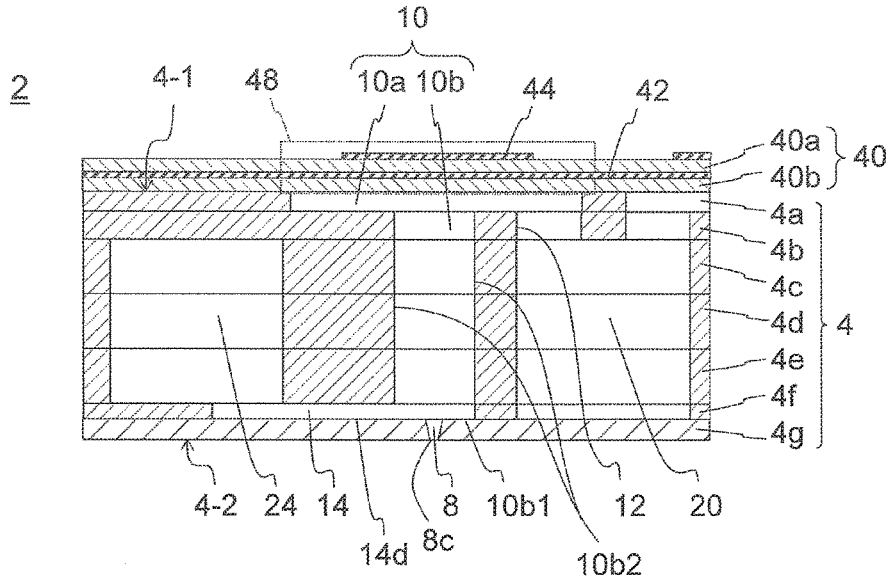

As shown in FIGS. 5 to 7, the first flow passage member 4 is formed by laminating a plurality of plates 4*a* to 4*g*, and has the pressurizing chamber surface 4-1 and a discharge hole surface 4-2. On the pressurizing chamber surface 4-1, the piezoelectric actuator substrate 40 is disposed so that liquid is discharged from the discharge hole 8 having a discharge port 8*c* opened on the discharge hole surface 4-2. A plurality of the plates 4*a* to 4*g* may each be formed of a metal, an alloy, or a resin. Moreover, the first flow passage member 4 may not be laminated with a plurality of the plates 4*a* to 4*g*, but may be integrally formed of a resin.

In the first flow passage member 4, a plurality of first common flow passages 20, a plurality of second common flow passages 24, and a plurality of discharge units 15 are formed, and the pressurizing chamber surface 4-1 is formed with openings 20*a* and 24*a*.

The first common flow passages 20 are provided to extend from the first direction D1 to the fourth direction D4, and formed to communicate with the openings 20*a*. In addition, the first common flow passages 20 are arranged in multiple lines from the second direction D2 to the fifth direction D5.

The second common flow passages 24 are provided to extend from the fourth direction D4 to the first direction D1, and formed to communicate with the openings 24*a*. In addition, the second common flow passages 24 are arranged in multiple lines from the second direction D2 to the fifth direction D5, and disposed between the adjoining first common flow passages 20. Accordingly, the first common flow passages 20 and the second common flow passages 24 extend each other in one direction, and disposed alternately in parallel toward another direction intersecting with the one direction.

Discharge units 15 each include, as shown in FIG. 7(*a*), the discharge hole 8, the pressurizing chamber 10, the first individual flow passage 12, and the second individual flow passage 14. The discharge units 15 are provided between the adjoining first common flow passages 20 and the second common flow passages 24, and are formed in a matrix shape in a surface direction of the first flow passage member 4. The discharge units 15 have discharge unit columns 15*a* and discharge unit lines 15*b*. The discharge unit columns 15*a* are arranged from the first direction D1 to the fourth direction D4, and the discharge unit lines 15*b* are arranged from the second direction D2 to the fifth direction D5. In addition, similar to the discharge unit columns 15*a*, pressurizing chamber columns 10*c* and discharge hole columns 8*a* are also arranged from the first direction D1 to the fourth direction D4. In addition, similar or identical to the discharge unit lines 15*b*, pressurizing chamber lines 10*d* and discharge hole lines 8*b* are also arranged from the second direction D2 to the fifth direction D5.

Angles between a line formed by the first direction D1 and the fourth direction D4 and a line formed by the second direction D2 and the fifth direction D5 are each offset from a right angle. Because of this, the discharge holes 8 belonging to the discharge hole columns 8*a* disposed from the first direction D1 to the fourth direction D4 are each other disposed by the offset from the right angle toward the second direction D2. Since the discharge hole columns 8*a* are disposed in parallel to the second direction D2, the discharge holes 8 belonging to the different discharge hole columns 8*a* are disposed by the offset toward the second direction D2. In combination of these offsets, the discharge holes 8 of the first flow passage member 4 are disposed at a predetermined interval in the second direction D2. Therefore, printing is possible to fill a predetermined region with a pixel formed by the discharged liquid.

In FIG. 6, when the discharge holes 8 are projected in the third direction D3 and the sixth direction D6, the 32 discharge holes 8 are projected in a region indicated by virtual straight lines R, and, within the virtual straight lines R, the discharge holes 8 each align at an interval of 360 dpi. Therefore, when the recording medium P is conveyed in a direction orthogonal to the virtual straight lines R for printing, printing is possible at a resolution of 360 dpi.

The discharge units 15 each include, as shown in FIG. 7, the discharge hole 8, the pressurizing chamber 10, the first individual flow passage 12, and the second individual flow passage 14. Moreover, in the liquid discharge head 2, liquid is supplied from the first individual flow passages 12 to the pressurizing chambers 10, and collected by the second individual flow passages 14 from the pressurizing chambers 10.

The pressurizing chamber 10 has a pressurizing chamber body 10*a* and a partial flow passage 10*b*. The pressurizing chamber body 10*a* forms a circular shape, when viewed in a plane, and the partial flow passage 10*b* extends downwardly from a center of the pressurizing chamber body 10*a*. The pressurizing chamber body 10*a* is configured to accept pressure from the displacement element 48 disposed on the pressurizing chamber body 10*a* to pressurize liquid in the partial flow passage 10*b*.

The pressurizing chamber body 10*a* has a cylindrical shape, and its planar shape shows a circular shape. The planar shape showing the circular shape can increase an amount of displacement, and therefore can increase a volumetric change caused by the displacement in each of the pressurizing chambers 10.

The partial flow passage 10*b* has a cylindrical shape having a diameter smaller than a diameter of the pressurizing chamber body 10*a*, and its planar shape shows a circular shape. The partial flow passage 10*b* has a pressurizing chamber under surface 10*b*1 and a side surface 10*b*2, and is disposed, when viewed from the pressurizing chamber surface 4-1, at a position fitting within the pressurizing chamber body 10*a*. The partial flow passage 10*b* connects the pressurizing chamber body 10*a* and the discharge hole 8.

Moreover, the partial flow passage 10*b* may have a conical shape or a truncated conical shape where a cross-sectional area decreases toward the discharge hole 8. Therefore, flow passage resistances in the first common flow passages 20 and the second common flow passages 24 can be increased to reduce a difference in pressure loss.

The pressurizing chambers 10 are disposed along both sides of each of the first common flow passages 20 to configure the pressurizing chamber columns 10*c*, one column on each side, two columns in total. The first common flow passages 20 and the pressurizing chambers 10 disposed in parallel on both sides of each of the first common flow passages 20 are connected via the first individual flow passages 12.

In addition, the pressurizing chambers 10 are disposed along both sides of each of the second common flow passages 24 to configure the pressurizing chamber columns 10*c*, one column on each side, two columns in total. The second common flow passages 24 and the pressurizing chambers 10 disposed in parallel on both sides of each of the second common flow passages 24 are connected via the second individual flow passages 14.

The first individual flow passages 12 each connect each of the first common flow passages 20 and the pressurizing chamber body 10*a*. After extended upwardly from upper surfaces of the first common flow passages 20, the first individual flow passages 12 are each connected to an under surface of the pressurizing chamber body 10*a*.

The second individual flow passages 14 each connect each of the second common flow passages 24 and the partial flow passage 10*b*. After extended from the under surfaces of the second common flow passages 24 toward the second direction D2 or the fifth direction D5, and then extended toward the first direction D1 or the fourth direction D4, the second individual flow passages 14 are each connected to the side surface 10*b*2 of the partial flow passage 10*b*.

With a configuration described above, in the first flow passage member 4, liquid supplied, via the openings 20*a*, to the first common flow passages 20 flows, via the first individual flow passages 12, into the pressurizing chamber bodies 10*a*, supplied to the partial flow passages 10*b*, and is partially discharged from the discharge holes 8. And then the remaining liquid is collected from the partial flow passages 10*b*, via the second individual flow passages 14, to the second common flow passages 24, and then collected from the first flow passage member 4, via the openings 24*a*, to the second flow passage member 6.

On an upper surface of the first flow passage member 4, the piezoelectric actuator substrate 40 including the displacement elements 48 is joined so that the displacement elements 48 are disposed in position on the pressurizing chambers 10. The piezoelectric actuator substrate 40 occupies a region having a shape approximately identical to a shape of a pressurizing chamber group formed with the pressurizing chambers 10. In addition, an opening of each of the pressurizing chambers 10 closes when the piezoelectric actuator substrate 40 is joined onto the pressurizing chamber surface 4-1 of the first flow passage member 4.

The piezoelectric actuator substrate 40 has a structure laminated with two piezoelectric ceramic layers 40*a* and 40*b* each including a piezoelectric material. The piezoelectric ceramic layers 40*a* and 40*b* each have a thickness of approximately 20 μm. Both the piezoelectric ceramic layers 40*a* and 40*b* extend over a plurality of the pressurizing chambers 10.

The piezoelectric ceramic layers 40*a* and 40*b* include, for example, a ceramic material having ferroelectricity, such as lead zirconate titanate (PZT) type, $NaNbO_3$ type, $BaTiO_3$ type, $(BiNa)NbO_3$ type, and $BiNaNb_5O_{15}$ type. Moreover, the piezoelectric ceramic layer 40*b* functions as a vibrating plate, and does not necessarily include a piezoelectric material, but may use a ceramic layer other than piezoelectric material and a metal plate.

The piezoelectric actuator substrate 40 is formed with a common electrode 42, individual electrodes 44, and connection electrodes 46. The common electrode 42 is formed almost entirely in a surface direction on a region between the piezoelectric ceramic layer 40*a* and the piezoelectric ceramic layer 40*b*. In addition, the individual electrodes 44 are respectively disposed at positions on an upper surface of the piezoelectric actuator substrate 40 so as to face the pressurizing chambers 10.

Portions interposed between the individual electrodes 44 and the common electrode 42 of the piezoelectric ceramic layer 40*a* are polarized in a thickness direction so as to form the displacement elements 48 each having a unimorph structure that is displaced when a voltage is applied onto the individual electrodes 44. Accordingly, the piezoelectric actuator substrate 40 has a plurality of the displacement elements 48.

The common electrode 42 can be formed of a metallic material such as Ag—Pd type, and a thickness of the common electrode 42 may be approximately 2 μm. The common electrode 42 has a surface electrode (not shown) for common electrode on the piezoelectric ceramic layer 40*a*, and the surface electrode for common electrode is connected to the common electrode 42 via a via hole formed when the surface electrode for common electrode penetrates into the piezoelectric ceramic layer 40*a*, and is grounded so that a ground potential is retained.

The individual electrodes 44 are each formed of a metallic material such as Au type, and each have an individual electrode body 44*a* and an extraction electrode 44*b*. As shown in FIG. 7(*a*), the individual electrode body 44*a* is formed in an approximately circular shape when viewed in a plane, and is formed smaller than the pressurizing chamber body 10*a*. The extraction electrode 44*b* extends from the individual electrode body 44*a*, and, onto the extended extraction electrode 44*b*, the connection electrodes 46 are formed.

The connection electrodes 46 include, for example, silver-palladium including glass frit, and are each formed protrudingly with a thickness of approximately 15 μm. The connection electrodes 46 are electrically joined to electrodes provided to the signal transmission sections 60.

Next, a liquid discharge operation will now be described herein. With a drive signal supplied to the individual electrodes 44 via the driver ICs 62 or other devices under a control of the control section 76, the displacement elements 48 are displaced. As a driving method, a so-called pull driving method can be used.

Figure 8A:
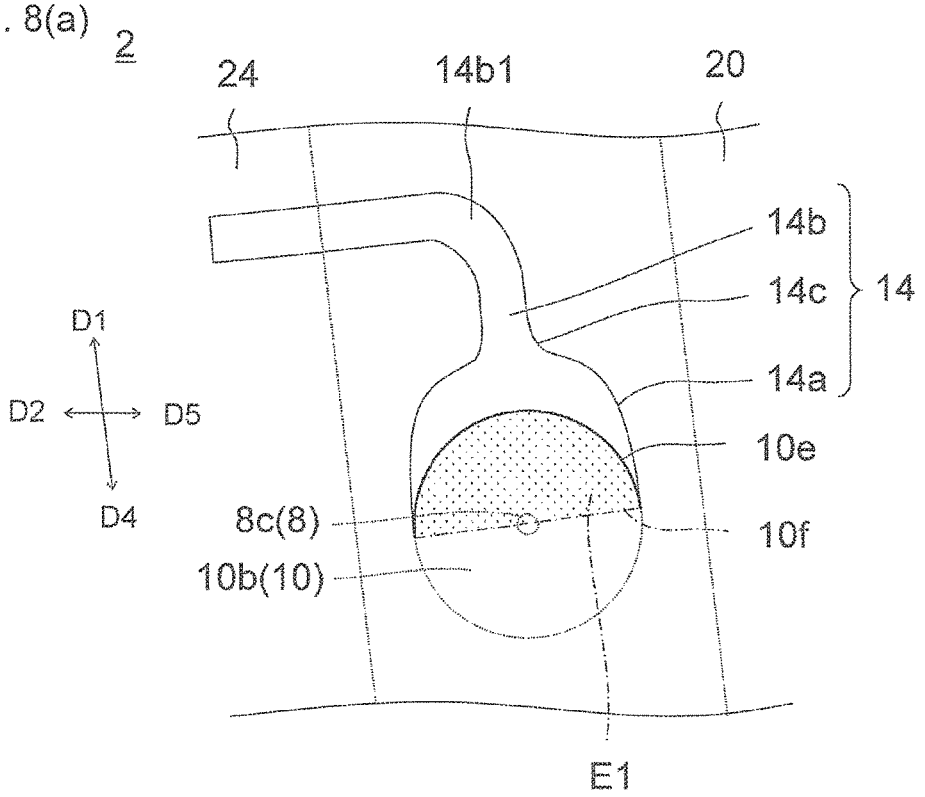
FIG. 8(*a*) is an enlarged plan view of a second individual flow passage, and FIG. 8(*b*) is another enlarged plan view of the second individual flow passage.
Figure 8B:
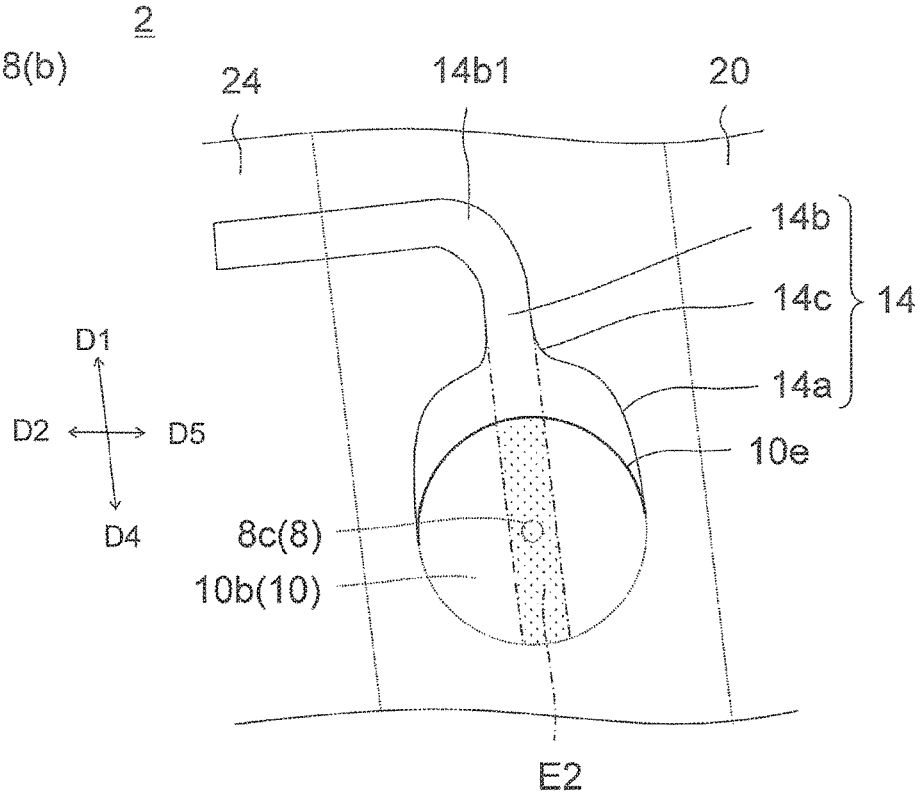
Figure 9A:
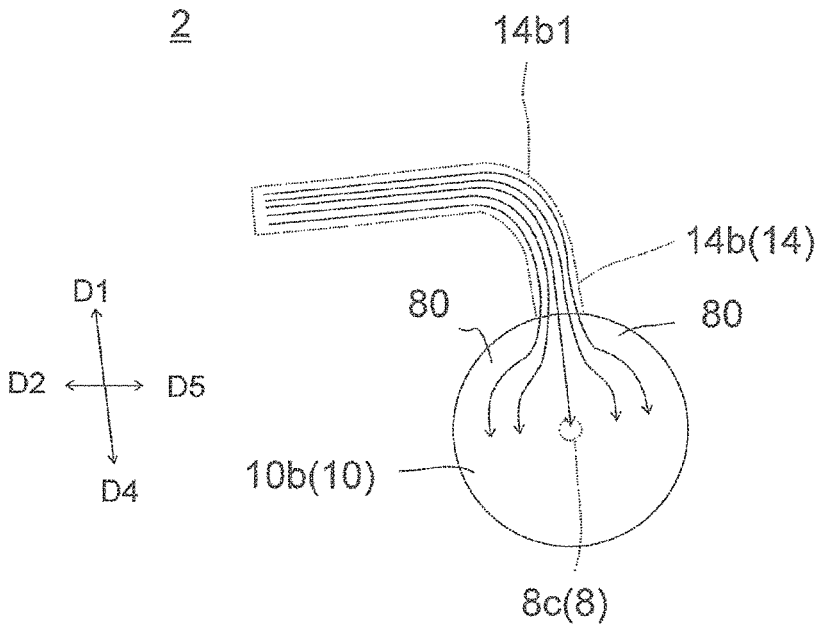
FIG. 9(*a*) is a schematic view illustrating a flow of liquid in a conventional liquid discharge head, and FIG. 9(*b*) is a schematic view illustrating a flow of liquid in the liquid discharge head according to the first embodiment of the present invention.
Figure 9B:
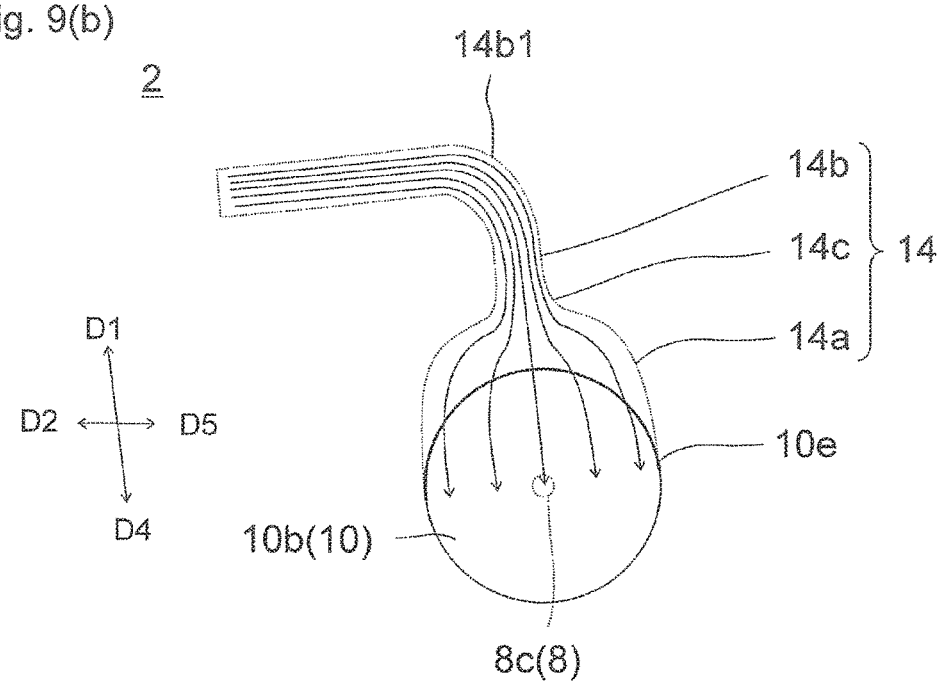

With reference to FIGS. 8 and 9, each of the second individual flow passages 14 of the liquid discharge head 2 will now be described herein in detail. FIGS. 8(*a*) and 8(*b*) show the second individual flow passage 14 in an enlarged manner, where FIG. 8(*a*) shows a first region E1, while FIG. 8(*b*) shows a second region E2. Moreover, the first region E1 and the second region E2 will be described later. In FIGS. 8(*a*) and 8(*b*), other members than the second individual flow passage 14 are shown with broken lines. FIGS. 9(*a*) and 9(*b*) show flow lines of liquid flowing into the second individual flow passage 14 and the partial flow passage 10*b*, where FIG. 9(*a*) shows a flow line in a conventional liquid discharge head, while FIG. 9(*b*) shows a flow line in the liquid discharge head 2 according to the first embodiment.

Moreover, although a flow line of liquid flowing into the second individual flow passage 14 and the partial flow passage 10*b* is actually in a direction of flow from the partial flow passage 10*b* to the second individual flow passage 14, such a flow line of liquid has a symmetric property, so a direction of flow from the second individual flow passage 14 to the partial flow passage 10*b* will now be described herein.

The second individual flow passage 14 has a wide section 14*a*, a narrow section 14*b*, and a connection section 14*c*. The wide section 14*a* is connected to the partial flow passage 10*b*, and formed wider than the narrow section 14*b*. A width of the wide section 14*b* gradually expands toward the partial flow passage 10*b*, i.e. in the fourth direction D4.

The narrow section 14*b* connects the wide section 14*a* and each of the second common flow passages 24 via the connection section 14*c*, and is formed narrower than the wide section 14*a*. The narrow section 14*b* is formed with a curved section 14*b*1 that curves in a middle. The narrow section 14*b* has an approximately constant width, and, after extended from the wide section 14*a* in the first direction D1, curves at the curved section 14*b*1, and then extends in a direction orthogonal to the first direction D1 and the fourth direction D4, to connect to the under surface of each of the second common flow passages 24.

The connection section 14*c* connects the wide section 14*a* and the narrow section 14*b*. A wall configuring the connection section 14*c* curves, when viewed in a plane. That is, as the connection section 14*c* extends, along the first direction D1 and the fourth direction D4, toward the partial flow passage 10*b*, the connection section 14*c* gradually curves in the direction orthogonal to the first direction D1 and the fourth direction D4.

The pressurizing chambers 10 each have a connection region 10*e* connected to the wide section 14*a*. The connection region 10*e* is formed over an arc of the partial flow passage 10*b*, and has a semicircular shape. As shown in FIG. 8(*a*), the pressurizing chambers 10 are each shown with a virtual line 10*f* connecting an end and another end of the connection region 10*e*, and, when viewed in a plane, each include the first region E1 surrounded by the connection region 10*e* and the virtual line 10*f*. In addition, as shown in FIG. 8(*b*), the pressurizing chambers 10 each include the second region E2 overlapping with an region extending in the fourth direction D4 from the narrow section 14*b*.

At this point, when the second individual flow passage 14 does not include the wide section 14*a*, and the narrow section 14*b* is connected to the partial flow passage 10*b*, liquid flowed into the second individual flow passage 14 is supplied, as shown in FIG. 9(*a*), to the partial flow passage 10*b*. At this time, inside the partial flow passage 10*b* having a wider width, liquid flowed into the narrow section 14*b* having a narrower width spreads out inside the partial flow passage 10*b*.

However, as shown in FIG. 9(*a*), in some cases, the liquid flowed into the second individual flow passage 14 cannot fully spread out inside the partial flow passage 10*b*, thus a region 80 in which the liquid stagnates may be created around a connection section between the second individual flow passage 14 and the partial flow passage 10*b*. Therefore, a pigment or other materials settled on the discharge hole 8 likely flow to clog the discharge hole 8.

On the other hand, with the liquid discharge head 2, since the wide section 14*a* is disposed to face the discharge hole 8 of the partial flow passage 10*b*, as shown in FIG. 9(*b*), liquid flowing into the liquid discharge head 2 flows so as to spread out inside the partial flow passage 10*b*. Therefore, the partial flow passage 10*b* can be prevented as much as possible from being internally created with the region 80 (see FIG. 9(*a*)) in which the liquid stagnates. In addition, the liquid can flow without being stagnated toward the discharge hole 8 of the partial flow passage 10*b*, and, as a result, a pigment or other materials contained in the liquid can be prevented from being settled to prevent as much as possible the discharge hole 8 from being clogged.

In addition, the second individual flow passage 14 includes the wide section 14*a* and the narrow section 14*b* so that the wide section 14*a* can prevent the partial flow passage 10*b* from being internally created with a region in which liquid stagnates, and the narrow section 14*b* can reduce unevenness in pressure loss in each of the discharge units 15.

Moreover, a direction toward the discharge hole 8 of the partial flow passage 10*b* means that the wide section 14*a* is connected, on the side surface 10*b*2 of the partial flow passage 10*b*, to a region at a height of up to 0.5 times of a height from the pressurizing chamber under surface 10*b*1 to the partial flow passage 10*b*. Moreover, it is advantageous that the wide section 14*a* is connected to a region at a height of up to 0.2 times of a height from the pressurizing chamber under surface 10*b*1 to the partial flow passage 10*b*.

In addition, it is advantageous that a cross-sectional area of the wide section 14*a* is 2 to 8 times of a cross-sectional area of the narrow section 14*b*. For example, when viewed in a plane, and when a width of the wide section 14*a* is 2 to 8 times of a width of the narrow section 14*b*, liquid flowing into the second individual flow passage 14 can be supplied, after the wide section 14*a* causes the liquid to flow in a wider region, to the partial flow passage 10*b*. As a result, the partial flow passage 10*b* can be prevented as much as possible from being internally created with the region 80 in which the liquid stagnates.

The width of the wide section 14*a* means a length orthogonal to the first direction D1 and the fourth direction D4, and, unless otherwise described, means the width of the wide section 14*a* connected to the connection region 10*e*. The width of the narrow section 14*b* means a length orthogonal to the first direction D1 and the fourth direction D4, and, unless otherwise described, represents the width of the narrow section 14*b* around the connection section 14*c*. Moreover, the cross-sectional area of the wide section 14*a* may be increased by increasing a depth of the wide section 14*a*.

In addition, when viewed in a plane, the width of the wide section 14*a* expands toward the partial flow passage 10*b*. Accordingly, the liquid flowing into the second individual flow passage 14 flows in a wider region as the liquid flows along the side surface of the wide section 14*a*. As a result, the liquid can flow in a wider region inside the partial flow passage 10*b*, thus the partial flow passage 10*b* can be prevented as much as possible from being internally created with the region 80 in which the liquid stagnates.

Further, the wide section 14*a* has, when viewed in a plane, an approximately circular shape. Accordingly, the liquid supplied from the narrow section 14*b* expands along the side surface of the wide section 14*a*, thus the wide section 14*a* can be prevented as much as possible from being internally created with a region in which the liquid stagnates.

In addition, the second individual flow passage 14 includes the connection section 14*c*, and, when viewed in a plane, the wall configuring the connection section 14*c* is curved. Therefore, the liquid flowed into the narrow section 14*b* can flow without being stagnated into the wide section 14*a*. That is, the region 80 in which the liquid stagnates around the connection section 14*c* can be prevented as much as possible from being created.

In addition, when viewed in a plane, the width of the wide section 14*a* in the connection region 10*e* is approximately identical to a width of the partial flow passage 10*b*. Therefore, a region in which the liquid spreads out by the wide section 14*a* can expand close to the width of the partial flow passage 10*b*. As a result, the partial flow passage 10*b* can be prevented as much as possible from being internally created with the region 80 in which the liquid stagnates.

In addition, as shown in FIG. 8(*a*), when viewed in a plane, the discharge hole 8 is disposed in the first region E1. Therefore, a region in which the liquid stagnates around the discharge hole 8 can be prevented as much as possible from being created. That is, the provided wide section 14*a* causes, in the first region E1, the liquid to flow in a wider region. In addition, the discharge hole 8 disposed in the first region E1 can prevent as much as possible liquid from being stagnated around the discharge hole 8.

Moreover, in the liquid discharge head 2, although an example in which part of the discharge hole 8 is disposed in the first region E1 is illustrated, it is preferable that the discharge hole 8 is entirely disposed in the first region E1.

In addition, as shown in FIG. 8(*b*), when viewed in a plane, the discharge hole 8 is disposed in the second region E2. Therefore, a region in which liquid stagnates around the discharge hole 8 can further be prevented as much as possible from being created. That is, since the width of the narrow section 14*b* is narrower than the width of the partial flow passage 10*b*, liquid flows into the narrow section 14*b* at a speed higher than a speed of the liquid flowing into the partial flow passage 10*b*.

An inertia force applied to the liquid flowing into the narrow section 14*b* causes the liquid to flow at a higher speed into a region extended from the narrow section 14*b* in the fourth direction D4. Accordingly, the liquid flows into the second region E2 at a speed higher than a speed of the liquid flowing into another region, thus, the liquid can flow at a higher speed around the discharge hole 8 disposed in the second region E2. As a result, the discharge hole 8 can be prevented as much as possible from being clogged.

In addition, the pressurizing chambers 10 are disposed between the first common flow passages 20 and the second common flow passages 24, where the second individual flow passages 14 extend from the pressurizing chambers 10 in the first direction D1. Therefore, the pressurizing chambers 10 can densely be disposed, while paste allowances for plates 4*e* to 4*g* of the first flow passage member 4 can be maintained. In addition, being extended from the pressurizing chambers 10 in the first direction D1, a length of each of the second individual flow passages 14 can be secured to reduce a flow passage resistance in the second individual flow passages 14.

In addition, the narrow section 14*b* has the curved section 14*b*1 curving toward each of the second common flow passages 24, where a radius of curvature of the curved section 14*b*1 is at least a half of a distance between each of the first common flow passages 20 and the second common flow passages 24. Therefore, an amount of the flowing liquid increases to prevent, if a flow passage resistance increases, a flow passage resistance for the liquid flowing into the curved section 14*b*1 from being increased excessively.

In addition, the pressurizing chambers 10 each include the pressurizing chamber body 10*a* and the partial flow passage 10*b*, where the wide section 14*a* is disposed toward the discharge hole 8 of the partial flow passage 10*b*. The partial flow passage 10*b* is connected to the pressurizing chamber body 10*a* and the second individual flow passage 14*b*, where, when liquid is supplied from the pressurizing chamber body 10*a*, a region in which the liquid stagnates internally can easily be created. On the other hand, the liquid discharge head 2 can allow liquid to flow without being stagnated toward the discharge hole 8 of the partial flow passage 10*b*, and, as a result, a pigment or other materials contained in the liquid can be prevented from being settled to prevent as much as possible the discharge hole 8 from being clogged.

As shown in FIG. 7(*b*), the pressurizing chamber 10 has the pressurizing chamber under surface 10*b*1, and the wide section 14*a* has the wide section under surface 14*d*. In addition, a height, from the discharge port 8*c*, of the wide section under surface 14*d* is identical to a height, from the discharge port 8*c*, of the pressurizing chamber under surface 10*b*1. Therefore, the pressurizing chamber under surface 10*b*1 and the wide section under surface 14*d* are formed flush. Accordingly, liquid can flow at a higher speed around the discharge hole 8 formed on the pressurizing chamber under surface 10*b*1. As a result, the discharge hole 8 can be prevented as much as possible from being clogged. Moreover, as described herein, a meaning of an identical height is not limited to a meaning that a height, from the discharge port 8*c*, of the wide section under surface 14*d* and a height, from the discharge port 8*c*, of the pressurizing chamber under surface 10*b*1 are completely identical, but can include a difference in height due to a manufacturing error or other reasons. That is, an identical height means a substantially identical height.

Moreover, the height, from the discharge port 8*c*, of the wide section under surface 14*d* may be lower than the height, from the discharge port 8*c*, of the pressurizing chamber under surface 10*b*1. In that case, liquid can flow at a further higher speed around the discharge port 8*c* formed on the pressurizing chamber under surface 10*b*1.

The liquid discharge head 2 supplies liquid from the first common flow passages 20, via the first individual flow passages 12, to a plurality of the pressurizing chambers 10, and collects the liquid in a plurality of the pressurizing chambers 10 from the second common flow passages 24 via the second individual flow passages 14. Therefore, the liquid flows, inside the partial flow passage 10*b*, from the discharge hole 8 toward the pressurizing chamber body 10*a*. As a result, even if an air bubble enters from the discharge port 8*c* into the partial flow passage, the air bubble can flow upwardly, in addition to buoyancy of the air bubble, by the flowing liquid. As a result, the air bubble can flow, via the pressurizing chamber body 10*a*, into each of the first common flow passages 20 to exit externally.

Moreover, in the liquid discharge head 2, although an example in which the pressurizing chambers 10 each include the pressurizing chamber body 10*a* and the partial flow passage 10*b*, the pressurizing chamber body 10*a* may be shaped to extend downwardly to exclude the partial flow passage 10*b*.

In that case, a region toward the discharge hole 8 of the pressurizing chamber 10 means that the wide section 14*a* is connected, on the side surface 10*b*2 of the pressurizing chamber body 10*a*, to a region at a height of up to 0.5 times of a height from the pressurizing chamber under surface 10*b*1 to the pressurizing chamber body 10*a*. Moreover, it is advantageous that the wide section 14*a* is connected to a region at a height of up to 0.2 times of a height from the pressurizing chamber under surface 10*b*1 to the pressurizing chamber body 10*a*.

In addition, it is advantageous that the first individual flow passage 12 is disposed higher than the second individual flow passage 14. Therefore, liquid flowing into the first individual flow passage 12 can easily flow into each of the pressurizing chambers 10 entirely to prevent as much as possible the liquid from being stagnated inside each of the pressurizing chambers 10. In addition, the wide section 14*a* may be disposed on the first individual flow passage 12.

<Modification Example 1 of First Embodiment>

Figure 10A:
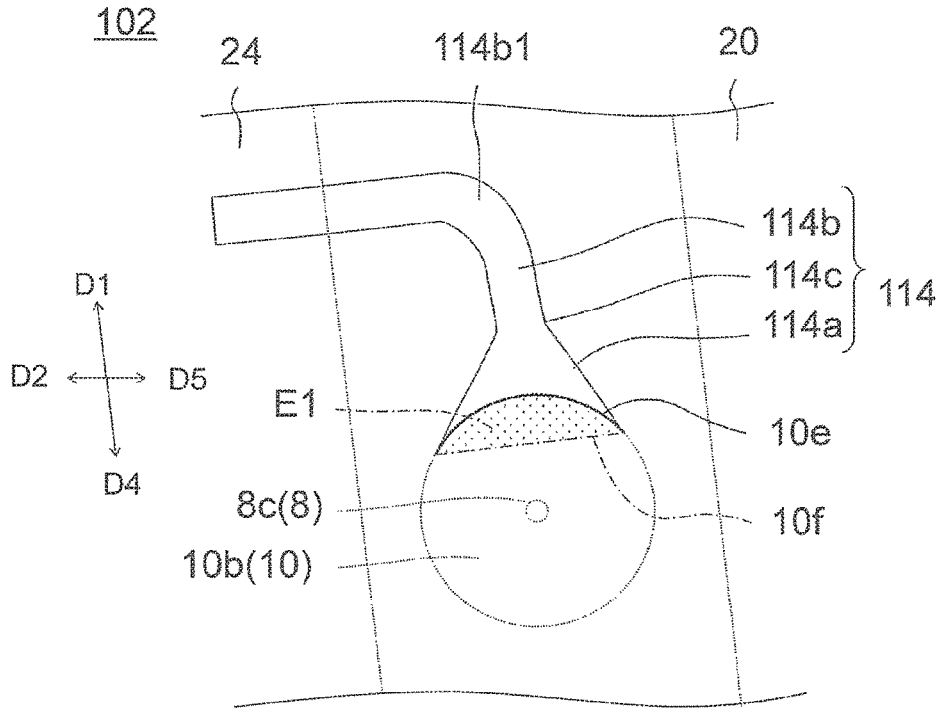
FIG. 10(*a*) is a plan view illustrating a first modification example of the first embodiment of the present invention, and FIG. 10(*b*) is a plan view illustrating a second modification example of the first embodiment of the present invention.
Figure 10B:
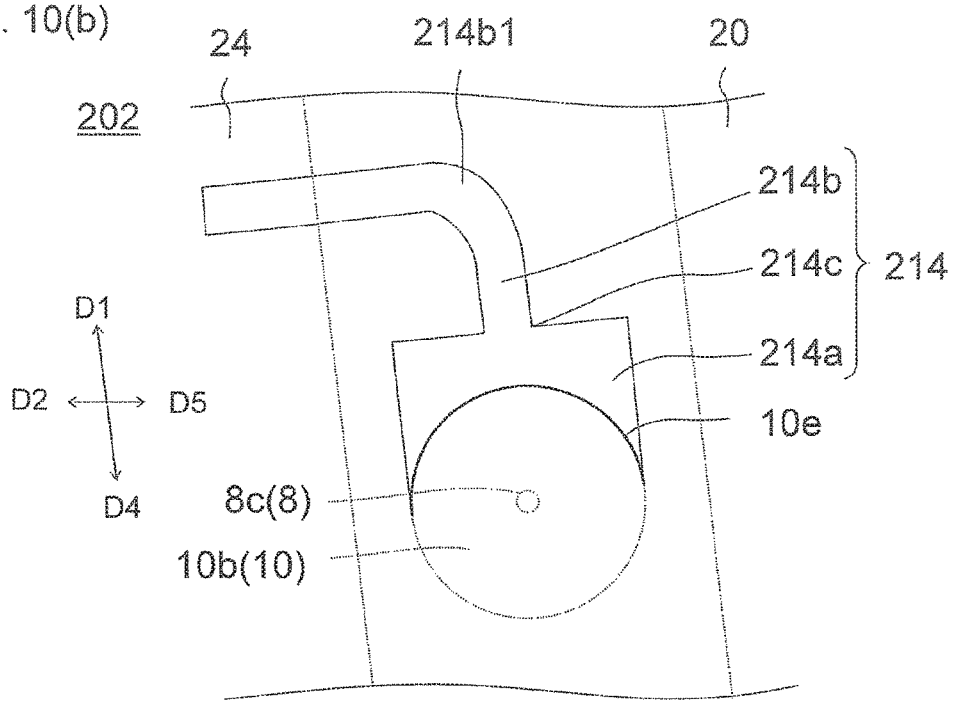

With reference to FIG. 10(*a*), a liquid discharge head 102 according to a modification example 1 of the first embodiment will now be described herein. The liquid discharge head 102 includes a second individual flow passage 114 that differs from the second individual flow passage of the liquid discharge head 2, but other points are identical to points of the liquid discharge head 2. Moreover, identical members are applied with identical reference characters.

The second individual electrode 114 has a wide section 114*a*, a narrow section 114*b*, and a connection section 114*c*. The wide section 114*a* is formed straight, when viewed in a plane, and expands in width toward the partial flow passage 10*b*. The wide section 114*a* is connected, via the connection region 10*e*, to the partial flow passage 10*b*.

Even in such a case, liquid flowed into the wide section 114*a* can flow entirely inside the partial flow passage 10*b*. That is, a region in which the liquid flows in the wide section 114*a* expands to, as a result, prevent as much as possible the liquid from being stagnated inside the partial flow passage 10*b*.

Moreover, it is preferable that, like the liquid discharge head 2 shown in FIG. 8(*a*), the connection region 10*e* having a diameter identical to a diameter of the partial flow passage 10*b* represented by the virtual line 10*f* is provided. Therefore, the first region E1 can expand to prevent as much as possible the wide section 14 from being internally created with a region in which liquid stagnates.

<Modification Example 2 of First Embodiment>

With reference to FIG. 10(*b*), a liquid discharge head 202 according to a modification example 2 of the first embodiment will now be described herein. The liquid discharge head 202 includes a second individual flow passage 214 that differs from the second individual flow passage of the liquid discharge head 2, but other points are identical. Moreover, identical members are applied with identical reference characters.

The second individual flow passage 214 has a wide section 214*a*, a narrow section 214*b*, and a connection section 214*c*. The wide section 214*a* is formed straight, when viewed in a plane, and has a constant width approximately identical to the width of the partial flow passage 10*b*.

Even in such a case, liquid flowed into the wide section 114*a* can flow and spread out inside the partial flow passage 10*b*. That is, a region in which the liquid flows in the wide section 114*a* expands to, as a result, prevent as much as possible the liquid from being stagnated inside the partial flow passage 10*b*.

Moreover, it is advantageous that, like the liquid discharge head 2 shown in FIG. 8(*a*), the width of the wide section 14*a* expands toward a partial flow passage 10*b*. Therefore, the wide section 14 can be prevented as much as possible from being created with a region in which the liquid stagnates.

<Second Embodiment>

Figure 11A:
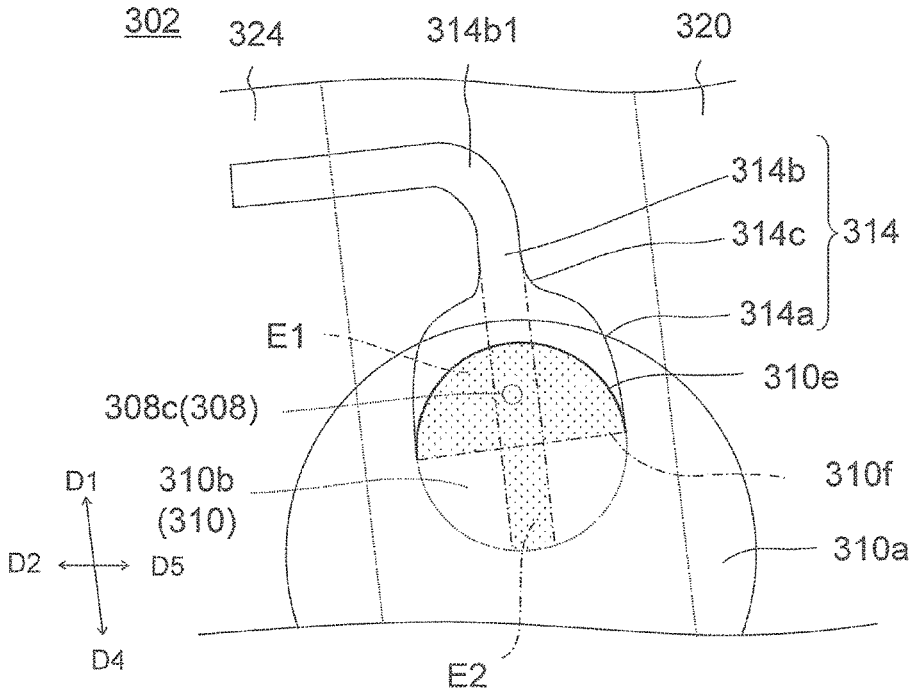
FIG. 11(*a*) is an enlarged plan view of a second individual flow passage of a liquid discharge head according to a second embodiment of the present invention, and FIG. 11(*b*) is a cross-sectional view of the liquid discharge head according to the second embodiment of the present invention.
Figure 11B:
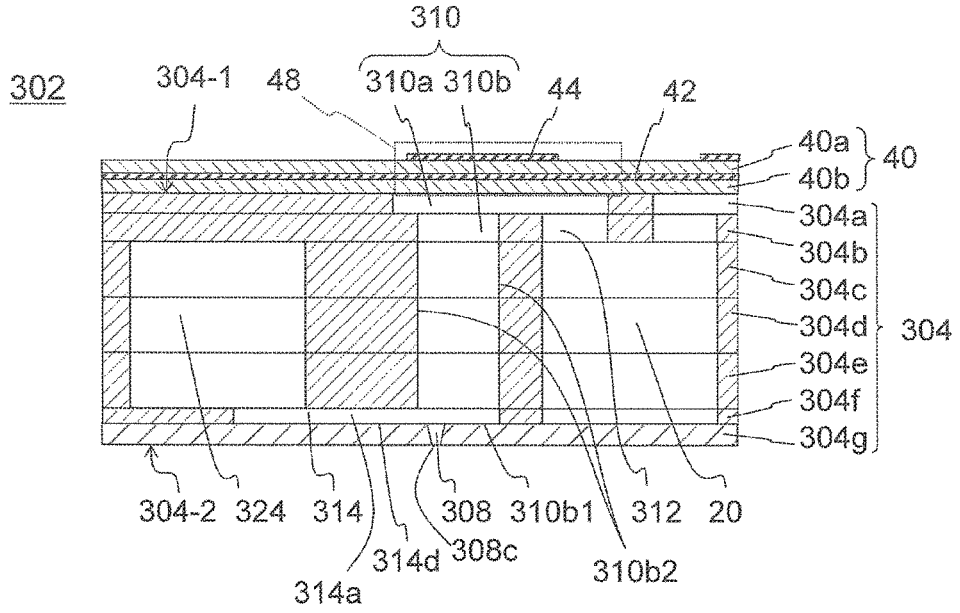

With reference to FIG. 11, a liquid discharge head 302 according to a second embodiment will now be described herein. Moreover, in the liquid discharge head 302, various flow passages formed in a first flow passage member 304 and liquid flow directions differ from the flow passages and directions of the liquid discharge head 2, but other points are identical, so descriptions of the other points are omitted.

In the liquid discharge head 302, the first flow passage member 304 includes a first common flow passage 320 and a second common flow passage 324. The first common flow passage 320 is connected with a first individual flow passage 312, and the second common flow passage 324 is connected with a second individual flow passage 314. The first common flow passage 320 is connected, via the openings 20*a* (see FIG. 4), to the first integrated flow passage 22 (see FIG. 4) of the second flow passage member 6 (see FIG. 4). The second common flow passage 324 is connected, via the openings 24*a* (see FIG. 4), to the second integrated flow passage 26 (see FIG. 4) of the second flow passage member 6.

In addition, the liquid discharge head 302 is supplied with liquid in a direction opposite to a direction toward which the liquid discharge head 2 is supplied with liquid. That is, the liquid supplied to the second integrated flow passage 26 is supplied, via each of the openings 24*a*, to the second common flow passage 324. The liquid supplied to the second common flow passage 324 is supplied, via the second individual flow passage 314, to a partial flow passage 310*b*. The liquid supplied to the partial flow passage 310*b* is partially discharged from a discharge hole 308, and the remaining liquid is supplied to a pressurizing chamber body 310*a*. The liquid supplied to the pressurizing chamber body 310*a* is collected, via the first individual flow passage 312, into the first common flow passage 320. The liquid collected by the first common flow passage 320 is collected, via the openings 20*a*, into the first integrated flow passage 22. As described above, the liquid discharge head 302 is formed with a circular structure by the first flow passage member 304 and the second flow passage member 6.

A pressurizing chamber 310 includes the pressurizing chamber body 310*a* and the partial flow passage 310*b* having a cross-sectional area smaller than a cross-sectional area of the pressurizing chamber body 310*a*. The pressurizing chamber body 310*a* and the partial flow passage 310*b* each have a circular cross-sectional shape, and an area center of gravity of the pressurizing chamber body 310*a* does not conform to an area center of gravity of the partial flow passage 310*b* where the area center of gravity of the partial flow passage 310*b* is disposed closer toward the first direction D1 than the area center of gravity of the pressurizing chamber body 310*a*. In addition, although not shown in the drawings, the pressurizing chamber body 310*a* is connected, toward the fourth direction, to the first individual flow passage 312.

The pressurizing chamber 310 has a first region E1 and a second region E2. The discharge hole 308 is disposed on the first region E1 and the second region E2. That is, the discharge hole 308 is disposed on a region where the first region E1 and the second region E2 overlap.

The second individual flow passage 314 includes a wide section 314*a*, a narrow section 314*b*, and a connection section 314*c*, and is connected to the partial flow passage 310*b* and a connection region 310*e*.

Liquid supplied from the partial flow passage 310*b* to the pressurizing chamber body 310*a* is collected into the first individual flow passage 312. At this point, when an area center of gravity of the pressurizing chamber body 310*a* conforms to an area center of gravity of the partial flow passage 310*b*, and, when the first individual flow passage 312 is connected to the pressurizing chamber body 310*a* in the fourth direction D4, liquid supplied from the partial flow passage 310*b* to the pressurizing chamber body 310*a* flows in the fourth direction D4, thus the liquid likely stagnates toward the first direction D1 in the pressurizing chamber body 310*a*.

On the other hand, in the liquid discharge head 302, an area center of gravity of the partial flow passage 310*b* is disposed closer toward the wide section 314*a* (first direction D1) than an area center of gravity of the pressurizing chamber body 310*a* so that the first individual flow passage 312 is connected to a side (the fourth direction D4) opposite to the wide section 314*a* of the pressurizing chamber body 310*a*. Accordingly, the liquid supplied from the partial flow passage 310*b* to the pressurizing chamber body 310*a* flows from the first direction D1 to the fourth direction D4 in the pressurizing chamber body 310*a*. As a result, the liquid can be prevented as much as possible from being stagnated inside the pressurizing chamber body 310*a*.

In addition, it is preferable that, when viewed in a plane, an outer periphery of the partial flow passage 310*b* and an outer periphery of the pressurizing chamber body 310*a* overlap. Therefore, the liquid is further prevented as much as possible from being stagnated inside the pressurizing chamber body 310*a*.

In addition, the liquid discharge head 302 supplies liquid from the second common flow passages 324, via the second individual flow passages 314, to a plurality of the pressurizing chambers 310, and collects the liquid in a plurality of the pressurizing chambers 310 from the first common flow passages 320 via the first individual flow passages 312. Therefore, the liquid present around the discharge holes 8 is facilitated to flow, thus liquid can flow at a higher speed under pressurizing chamber under surfaces 310*b*3 and 310*b*4.

<Modification Example of Second Embodiment>

Figure 12:
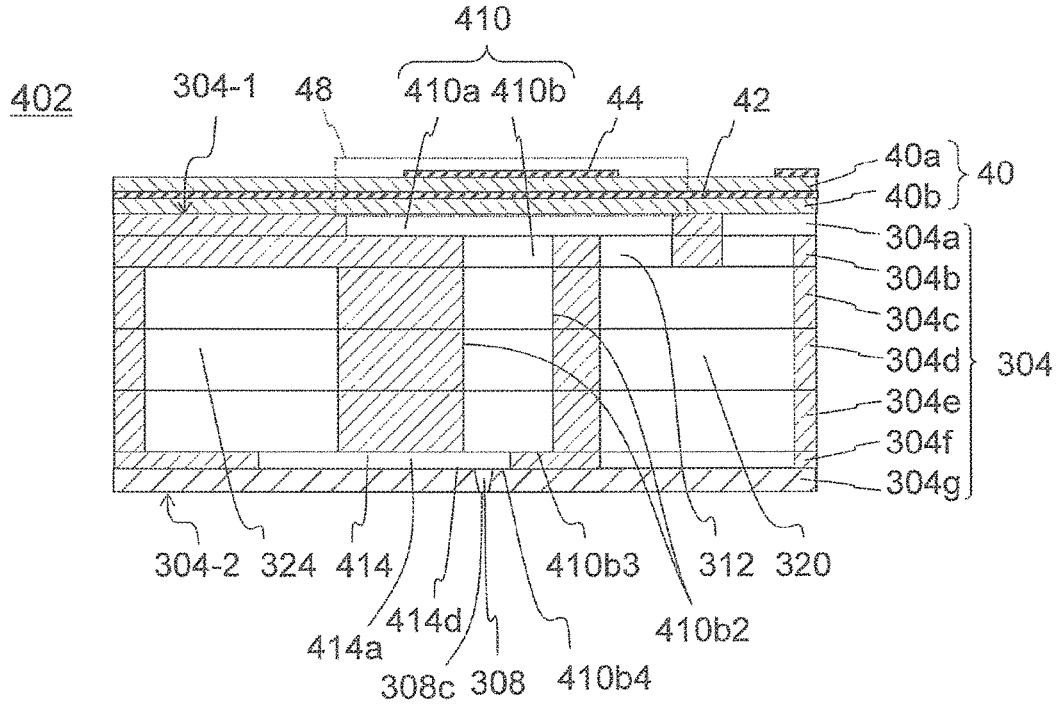
FIG. 12(*a*) is a cross-sectional view illustrating a modification example of the second embodiment of the present invention.

With reference to FIG. 12, a liquid discharge head 402 according to a modification example of the second embodiment will now be described herein. In the liquid discharge head 402, a pressurizing chamber 410 and a second individual flow passage 412 differ from the chambers and passages of the liquid discharge head 302.

The pressurizing chamber 410 includes a pressurizing chamber body 410*a* and a partial flow passage 410*b*. The partial flow passage 410*b* has a side surface 410*b*2, a pressurizing chamber under surface 410*b*4 positioned toward the first direction D1, and a pressurizing chamber under surface 410*b*3 positioned toward the fourth direction D4. In addition, a height, from a discharge port 308*c*, of the pressurizing chamber under surface 410*b*4 positioned toward the first direction D1 is lower than a height, from the discharge port 308*c*, of the pressurizing chamber under surface 410*b*3 positioned toward the fourth direction D4.

Since a distance between the pressurizing chamber under surface 410*b*4 positioned toward a wide section 414*a* (first direction D1) and the discharge port 308*c* is shorter than a distance between the pressurizing chamber under surface 410*b*3 positioned on a side opposite to the wide section 414*a* (fourth direction D4) and the discharge port 308*c*, the liquid discharge head 402 can prevent as much as possible liquid from being stagnated inside the partial flow passage 410*b*.

That is, in the partial flow passage 310*b* shown in FIG. 11(*a*), the liquid is difficult to flow toward the fourth direction D4 in a second region, thus the liquid likely stagnates. However, as shown in FIG. 12, the liquid discharge head 402 is not formed with the partial flow passage 410*b* in a region in which liquid is difficult to flow. Therefore, the liquid can be prevented as much as possible from being stagnated inside the partial flow passage 410*b*.

Moreover, it is preferable that a wide section under surface 414*d* of a second individual flow passage 414 and the pressurizing chamber under surface 410*b*4 positioned toward the first direction D1 are formed flush. Therefore, the liquid can be prevented as much as possible from being stagnated in a connection region (not shown) between the wide section 414*a* and the partial flow passage 410*b*. Further, the liquid can flow at a higher speed around the discharge hole 308 to prevent as much as possible the discharge hole 308 from being clogged.

Although the first to fourth embodiments have been described above, the present invention should not be limited to the above described embodiments, but may be variously changed without departing from the scope of the present invention.

For example, as the pressurizing section, the pressurizing chamber 10 is pressurized through a piezoelectric deformation of a piezoelectric actuator, but the pressurizing section is not limited to this example. For example, a pressurizing section may provide a heating section per each of the pressurizing chambers 10 to heat liquid in the pressurizing chambers 10 with the heating sections to pressurize the liquid through thermal expansion.

DESCRIPTION OF THE REFERENCE NUMERAL

1: Color inkjet printer
2: Liquid discharge head
2*a*: Head body
4: First flow passage member
4*a*~4*g*: Plate(s)
4-1: Pressurizing chamber surface
4-2: Discharge hole surface
6: Second flow passage member
8: Discharge hole
8*c*: Discharge port
10: Pressurizing chamber
10*a*: Pressurizing chamber body
10*b*: Partial flow passage
10*b*1: Pressurizing chamber under surface
10*b*2: Side surface
12: First individual flow passage (first flow passage)
14: Second individual flow passage (third flow passage)
14*a*: Wide section
14*b*: Narrow section
14*c*: Connection section
15: Discharge unit
20: First common flow passage
22: First integrated flow passage
24: Second common flow passage (fourth flow passage)
26: Second integrated flow passage
40: Piezoelectric actuator substrate
48: Displacement element
50: Housing
52: Heat sink
76: Control section
P: Recording medium
D1: First direction
D2: Second direction
D3: Third direction
D4: Fourth direction
D5: Fifth direction
D6: Sixth direction
E1: First region
E2: Second region

The invention claimed is:

1. A liquid discharge head comprising:

a flow passage member comprising:

a plurality of discharge holes;

a plurality of pressurizing chambers respectively connected to the plurality of discharge holes;

a plurality of first flow passages respectively connected to the plurality of pressurizing chambers;

a second flow passage connected in common to the plurality of first flow passages;

a plurality of third flow passages respectively connected to the plurality of pressurizing chambers; and a fourth flow passage connected in common to the plurality of third flow passages; and a plurality of pressurizing sections respectively pressurizing liquid in the plurality of pressurizing chambers, wherein each of the plurality of pressurizing chambers comprise a pressurizing chamber body and a partial flow passage extending from the pressurizing chamber body to a discharge hole, the partial flow passage being connected with a respective third flow passage, and wherein each of the plurality of third flow passages comprise a wide section connected to a respective pressurizing chamber, and a narrow section connecting the wide section and the fourth flow passage, the wide section being disposed toward a respective discharge hole of the pressurizing chamber, and the narrow section is formed narrower than the wide section.

2. The liquid discharge head according to claim 1, wherein a cross-sectional area of the wide section is 2 to 8 times of a cross-sectional area of the narrow section.

3. The liquid discharge head according to claim 1, wherein, when viewed in a plane, the wide section expands in width toward the pressurizing chamber.

4. The liquid discharge head according to claim 3, wherein at least one of the plurality of third flow passages further comprises a connection section connecting the wide section and the narrow section, and, when viewed in a plane, a wall configuring the connection section is curved.

5. The liquid discharge head according to claim 1, wherein, when viewed in a plane, a width at a section where the wide section is connected to the pressurizing chamber is identical to a width of the pressurizing chamber.

6. The liquid discharge head according to claim 1, wherein, when viewed in a plane, at least one of the plurality of pressurizing chambers comprises a connection region connected to the wide section and a first region surrounded by a virtual line connecting an end and another end of the connection region, the first region being disposed with the discharge hole.

7. The liquid discharge head according to claim 1, wherein the wide section is disposed toward the discharge hole of the partial flow passage.

8. The liquid discharge head according to claim 1, wherein, when viewed in a plane, the second flow passage and the fourth flow passage respectively extend in one direction, and disposed in parallel to another direction orthogonal to the one direction, a plurality of the pressurizing chambers is disposed between the second flow passage and the fourth flow passage, and a plurality of the third flow passages extends from the pressurizing chamber in the one direction.

9. The liquid discharge head according to claim 8, wherein, when viewed in a plane, the narrow section comprises a curved section curving toward the fourth flow passage, and a radius of curvature of the curved section is at least a half of a distance between, in the other direction, the second flow passage and the fourth flow passage.

10. The liquid discharge head according to claim 8, wherein, when viewed in a plane, at least one of the plurality of pressurizing chambers comprises a second region overlapping with a region extending from the narrow section in the one direction, the second region being disposed with the discharge hole.

11. The liquid discharge head according to claim 10, wherein, when viewed in a plane, an area center of gravity of the partial flow passage is disposed closer toward the wide section than an area center of gravity of the at least one pressurizing chamber body, and the first flow passage is disposed on a side opposite to the wide section of the at least one pressurizing chamber body.

12. The liquid discharge head according to claim 1, wherein at least one of the plurality of pressurizing chambers comprises a pressurizing chamber under surface positioned toward the discharge hole, the wide section comprises a wide section under surface positioned toward the discharge hole, the discharge hole comprises a discharge port for discharging the liquid, and a height, from the discharge port, of the wide section under surface is identical to a height, from the discharge port, of the pressurizing chamber under surface or lower than a height, from the discharge port, of the pressurizing chamber under surface.

13. The liquid discharge head according to claim 12, wherein, on the pressurizing chamber under surface, a height, from the discharge port, of the pressurizing chamber under surface positioned toward the wide section is identical to a height, from the discharge port, of the wide section under surface, and, on the pressurizing chamber under surface, lower than a height, from the discharge port, of the pressurizing chamber under surface positioned on a side opposite to the wide section.

14. The liquid discharge head according to claim 1, wherein liquid is supplied from the second flow passage, via a plurality of the first flow passages, to a plurality of the pressurizing chambers, and the liquid in a plurality of the pressurizing chambers is collected from the fourth flow passage via a plurality of the third flow passages.

15. The liquid discharge head according to claim 1, wherein liquid is supplied from the fourth flow passage, via the plurality of third flow passages, to the plurality of pressurizing chambers, and the liquid in the plurality of pressurizing chambers is collected from the second flow passage via the plurality of first flow passages.

16. A recording device comprising:

a liquid discharge head according to claim 1;

a conveyor for conveying a recording medium toward the liquid discharge head; and a control section for controlling the liquid discharge head.

* * * * *